US012414597B2

(12) United States Patent
Bischofberger et al.

(10) Patent No.: US 12,414,597 B2
(45) Date of Patent: Sep. 16, 2025

(54) BICYCLE HELMET WITH MODULAR IMPACT ABSORBING STRUCTURES

(71) Applicant: Specialized Bicycle Components, Inc., Morgan Hill, CA (US)

(72) Inventors: Allen Albert Bischofberger, Ben Lomond, CA (US); Luiz Felipe de Melo Dias, Minas Gerais (BR); Alexander Hart Jerome, Morgan Hill, CA (US); David Tyler Debus, Felton, CA (US); Christopher Thomas Pietrzak, Redwood City, CA (US)

(73) Assignee: Specialized Bicycle Components, Inc., Morgan Hills, CA (US)

( * ) Notice: Subject to any disclaimer, the term of this patent is extended or adjusted under 35 U.S.C. 154(b) by 255 days.

(21) Appl. No.: 17/825,756

(22) Filed: May 26, 2022

(65) Prior Publication Data

US 2022/0378141 A1 Dec. 1, 2022

Related U.S. Application Data

(60) Provisional application No. 63/194,738, filed on May 28, 2021.

(51) Int. Cl.
*A42B 3/12* (2006.01)
*A42B 3/00* (2006.01)
(Continued)

(52) U.S. Cl.
CPC ..... *A42B 3/128* (2013.01); *A42B 3/00* (2013.01); *A42B 3/0406* (2013.01); *A42B 3/06* (2013.01);
(Continued)

(58) Field of Classification Search
CPC ..... A42B 3/28
See application file for complete search history.

(56) References Cited

U.S. PATENT DOCUMENTS 3,946,441 A * 3/1976 Johnson ..... A42B 3/063 2/412
5,035,009 A * 7/1991 Wingo, Jr. ..... A42B 3/121 2/425
(Continued)

FOREIGN PATENT DOCUMENTS

DE 102017108038 A1 10/2018
WO 2011025482 A1 3/2011
(Continued)

OTHER PUBLICATIONS

Audane, S. Lazer Blade helmet + aero shell product page. Oct. 15, 2015. Retrieved on Jan. 19, 2021 from https://road.cc/content/review/161935-lazer-blade-helmet-aero-shell (10 pages).
(Continued)

*Primary Examiner* — Katherine M Moran
(74) *Attorney, Agent, or Firm* — Michael Best & Friedrich LLP

(57) ABSTRACT

A helmet includes an outer shell having an interior and an exterior and an impact absorbing layer positioned on the interior of the outer shell. The impact absorbing layer includes a first impact absorbing structure having a first interface and a second impact absorbing structure having a second interface in lateral compression against the first interface.

19 Claims, 22 Drawing Sheets

(51) Int. Cl.

| | |
|---|---|
| ***A42B 3/04*** | (2006.01) |
| ***A42B 3/06*** | (2006.01) |
| ***A42B 3/28*** | (2006.01) |
| *A42B 3/14* | (2006.01) |
| *A42B 3/20* | (2006.01) |
| *A42B 3/32* | (2006.01) |

(52) U.S. Cl.
CPC ..... *A42B 3/28* (2013.01); *A42B 3/04* (2013.01); *A42B 3/125* (2013.01); *A42B 3/145* (2013.01); *A42B 3/205* (2013.01); *A42B 3/324* (2013.01); *A42B 3/326* (2013.01)

(56) References Cited

U.S. PATENT DOCUMENTS

| | | | | |
|---|---|---|---|---|
| 5,950,244 | A * | 9/1999 | Fournier | A42B 3/128 2/425 |
| 6,009,561 | A | 1/2000 | Bullock et al. | |
| 6,317,896 | B1 | 11/2001 | Timms et al. | |
| 6,332,227 | B1 | 12/2001 | Fang | |
| 7,565,704 | B2 | 7/2009 | Wu | |
| 8,015,625 | B2 | 9/2011 | Grim et al. | |
| 8,032,993 | B2 | 10/2011 | Musal | |
| 8,037,548 | B2 | 10/2011 | Alexander et al. | |
| 8,146,177 | B2 | 4/2012 | Mangone | |
| 8,176,574 | B2 | 5/2012 | Bryant et al. | |
| 8,220,078 | B2 | 7/2012 | Wang | |
| 8,370,967 | B2 | 2/2013 | Chen | |
| 8,510,870 | B2 | 8/2013 | Rogers et al. | |
| 9,357,811 | B2 | 6/2016 | Chiang | |
| 9,433,252 | B2 | 9/2016 | Lebel et al. | |
| 9,526,291 | B2 | 12/2016 | Beauchamp et al. | |
| 9,572,390 | B1 | 2/2017 | Simpson | |
| 9,572,391 | B2 * | 2/2017 | McInnis | A42B 3/124 |
| 9,795,180 | B2 | 10/2017 | Lowe et al. | |
| D808,083 | S | 1/2018 | Durham et al. | |
| 9,872,532 | B2 | 1/2018 | Muller | |
| 10,021,932 | B2 | 7/2018 | Shearman et al. | |
| 10,098,407 | B2 * | 10/2018 | Kele | A42B 3/16 |
| 10,271,603 | B2 * | 4/2019 | Briggs | A42B 3/064 |
| 10,321,729 | B2 | 6/2019 | Aguilera Robles et al. | |
| 10,342,283 | B2 | 7/2019 | Glover et al. | |
| 10,420,385 | B2 * | 9/2019 | Lakes | A42B 3/145 |
| 10,492,555 | B2 | 12/2019 | Lebel et al. | |
| 10,736,373 | B2 * | 8/2020 | Chilson | A42B 3/127 |
| 10,765,164 | B2 | 9/2020 | Giroux Bernier et al. | |
| 10,786,028 | B2 | 9/2020 | Cech et al. | |
| 2006/0070170 | A1 * | 4/2006 | Copeland | A63B 71/10 2/412 |
| 2006/0112477 | A1 | 6/2006 | Schneider | |
| 2007/0157370 | A1 | 7/2007 | Joubert Des Ouches | |
| 2010/0050324 | A1 | 3/2010 | Musal | |
| 2013/0232670 | A1 | 9/2013 | Janetos | |
| 2014/0223641 | A1 * | 8/2014 | Henderson | A42B 3/065 2/411 |
| 2015/0047110 | A1 | 2/2015 | Chilson | |
| 2015/0074876 | A1 | 3/2015 | Chiang | |
| 2015/0089725 | A1 * | 4/2015 | Lowe | A42B 3/125 2/410 |
| 2015/0282550 | A1 | 10/2015 | Musal | |
| 2015/0305428 | A1 | 10/2015 | Lakes et al. | |
| 2017/0318893 | A1 | 11/2017 | Durham et al. | |
| 2018/0360151 | A1 | 12/2018 | Desjardins et al. | |
| 2019/0045874 | A1 | 2/2019 | Kele | |
| 2020/0229530 | A1 | 7/2020 | Feher | |
| 2021/0007432 | A1 | 1/2021 | Santiago et al. | |
| 2022/0087355 | A1 * | 3/2022 | Wagnac | A42B 3/124 |
| 2022/0175074 | A1 | 6/2022 | Rietdyk | |
| 2022/0395046 | A1 | 12/2022 | Fischer et al. | |

FOREIGN PATENT DOCUMENTS

| | | | |
|---|---|---|---|
| WO | 2011149895 | A1 | 12/2011 |
| WO | 2017152151 | A1 | 9/2017 |
| WO | 2019195339 | A1 | 10/2019 |
| WO | 2019237025 | A1 | 12/2019 |

OTHER PUBLICATIONS

Lazersport. Blade+ webpage, 2021, Retrieved on Jan. 19, 2021 from https://lazersport.us/collections/road/products/blade-plus (3 pages).
Life Changing Products. Helmet Camera Mount for Action Camera product page, Version dated May 11, 2021, available online at https://web.archive.org/web/20210511063355/https://lcpshop.net/product/helmet-camera-mount-action-camera/ (21 pages).
Ride 509. Universal Helmet Camera Mount product page, https://ride509.com/products/universal-helmet-camera-mount, available online at least as early as Jan. 18, 2021, 11 pages.
Whitted, E. How to mount an action camera on a helmet. Oct. 2, 2019, available online at https://myactionreviews.com/how-to-mount-an-action-camera-on-a-helmet/ (8 pages).
European Patent Office Extended European Search Report for application 22175924.4, dated Oct. 24, 2022 (8 pages).
European Patent Office Extended European Search Report for application 22175926.9, dated Oct. 24, 2022 (8 pages).
DHGate. Lightweight Tactical Crashworthy Protective Helment Head Protector Face Mask Outdoor Cycling Helmets for CS Paintball Game product page. Available at least as early as Feb. 11, 2021 at <https://www.dhgate.com/product/lightweight-tactical-crashworthy-protective/415570974.html> (9 pages).
Vicis Inc. Manufacturing impact absorbing structures for an athletic helmet. Jan. 5, 2017. Available online at <https://patents.justia.com/patent/10342283> (17 pages).
European Patent Office Action for Application No. 22175924.4 dated Aug. 14, 2024 (4 pages).

* cited by examiner

BICYCLE HELMET WITH MODULAR IMPACT ABSORBING STRUCTURES

CROSS-REFERENCE TO RELATED APPLICATIONS

This application claims priority to U.S. Provisional Application No. 63/194,738, filed May 28, 2021, the entire contents of which are incorporated herein by reference.

BACKGROUND

The present disclosure relates generally to the field of helmets and specifically to a bicycle helmet having impact absorbing structures. The present disclosure also relates generally to the field of bicycle helmets and specifically to a system for adjusting the fit of a bicycle helmet. The present disclosure also relates generally to the field of bicycle helmets and specifically to a system for mounting items to a bicycle helmet.

Bicycle helmets commonly include a hard outer shell, an impact absorbing inner shell, and a fit system that secures the helmet to a rider's head. The inner shell is made of an energy-absorbing material. The fit system often includes one or more adjustable straps that are designed to wrap around at least a portion of a rider's head. An adjustment mechanism can be used to adjust the straps to the size of the rider's head.

DETAILED DESCRIPTION

Figure 1:
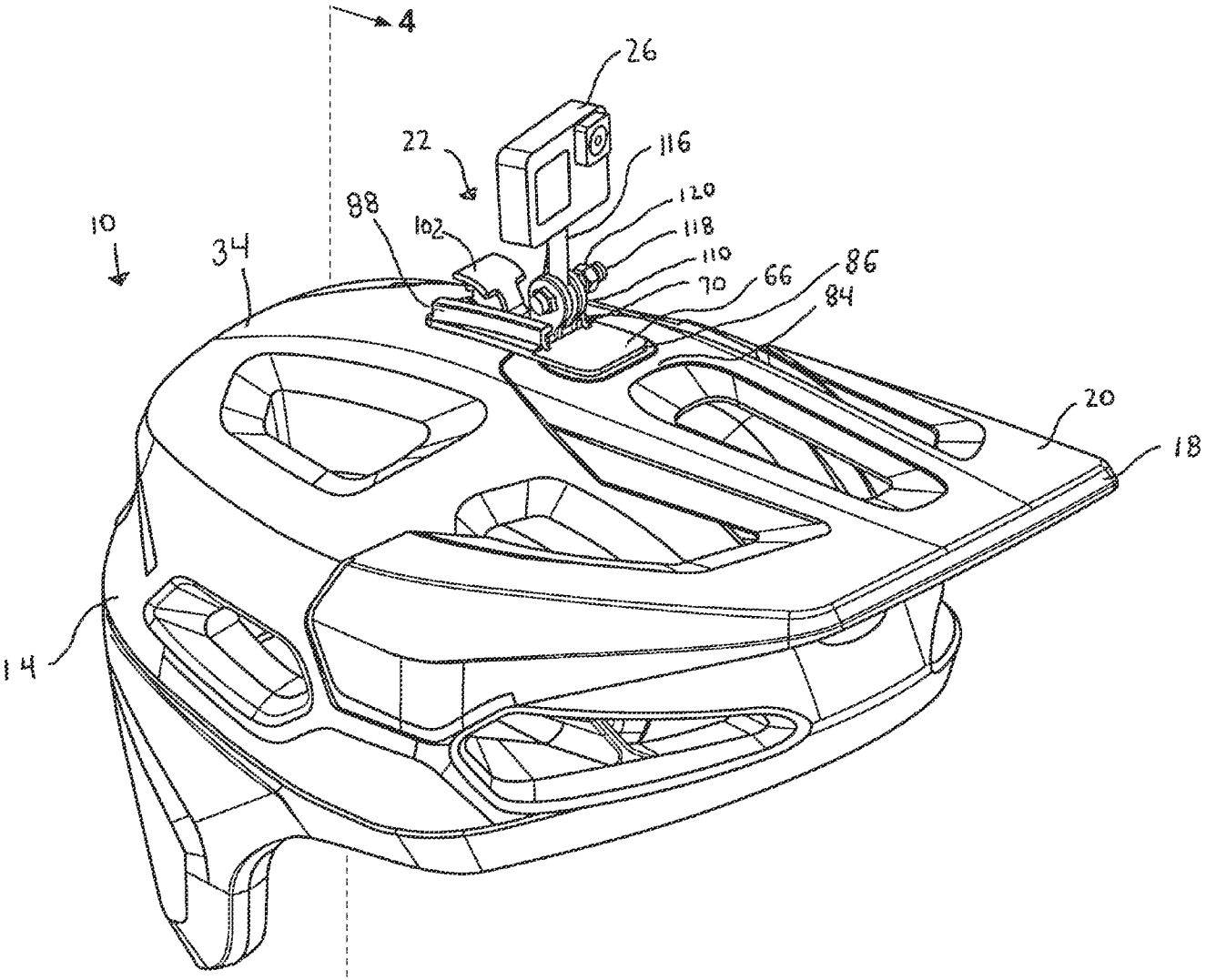
FIG. 1 is a perspective view of a bicycle helmet according to an embodiment, including an accessory coupled to the helmet.

Before any embodiments are explained in detail, it is to be understood that the present disclosure is not limited in its application to the details of construction and the arrangement of components set forth in the following description or illustrated in the following drawings. The disclosure is capable of other embodiments and of being practiced or of being carried out in various ways.

According to an exemplary embodiment, a helmet comprises an outer shell having an interior and an exterior and an impact absorbing layer positioned on the interior of the outer shell. The impact absorbing layer comprises a first impact absorbing structure having a first interface and a second impact absorbing structure having a second interface in lateral compression against the first interface.

According to another exemplary embodiment, a helmet comprises an outer shell having a first receiving portion and an impact absorbing layer positioned on an interior side of the outer shell. The impact absorbing layer comprises an impact absorbing structure having a first engagement portion and a second engagement portion spaced from the first engagement portion. The impact absorbing structure is mechanically secured to the outer shell by the first engagement portion engaging the first receiving portion and the second engagement portion engaging a second receiving portion spaced from the first receiving portion.

According to another exemplary embodiment, a method of assembling a helmet from an outer shell and multiple impact absorbing structures comprises securing by lateral compression a first impact absorbing structure with the outer shell. The securing by lateral compression the first impact absorbing structure with the outer shell comprises contacting the first impact absorbing structure with the outer shell deflecting a first deflecting portion of at least one of the first impact absorbing structure or the outer shell from a static position to a deflected position, moving the first impact absorbing structure further toward the outer shell, and relaxing the first deflecting portion back from the deflected position toward the static position to mechanically secure the first impact absorbing structure in the outer shell.

According to another exemplary embodiment, a bicycle helmet comprises a helmet body adapted to cover at least a portion of a rider's head. The helmet body including a wall portion and a vent extending through the wall portion from an exterior of the helmet body to an interior of the helmet body. An adjusting assembly is provided for adjustably securing the helmet to a user's head. The adjusting assembly includes an adjusting input movable to adjust a size of the helmet. The adjusting input is positioned at least partially in the vent.

According to another exemplary embodiment, a bicycle helmet comprises a helmet body adapted to cover at least a portion of a rider's head. The helmet body comprises a mounting structure adapted to mount an accessory, and a visor coupled to the helmet body. The visor comprises a main body and a removable panel removably secured to the main body and positioned to cover the mounting structure. The helmet body may include an impact-absorbing layer, wherein the mounting structure is recessed in the impact-absorbing layer. The helmet body may include an outer shell covering at least a portion of the impact-absorbing layer, and the outer shell may include a shell opening aligned with the mounting structure. The removable panel of the visor may be aligned with the shell opening in the outer shell. The helmet body may have an outer surface adjacent the mounting structure, the outer surface defining a tangential plane, and the mounting structure may include an upper mount portion having an upper width parallel to the tangential plane, and a lower mount portion having a lower width parallel to the tangential plane, the lower width being larger than the upper width. The mounting structure may include a plurality of spaced-apart finger portions connecting the upper mount portion to the lower mount portion. The visor may include a visor opening aligned with the mounting structure, the visor opening being substantially covered by the removable panel. The visor may include a recessed ledge around at least a portion of the visor opening, the recessed ledge supporting the removable panel. An upper surface of the removable panel may be substantially flush with an upper surface of the main body of the visor.

According to another exemplary embodiment, a bicycle helmet comprises a helmet body adapted to cover at least a portion of a rider's head. The helmet body comprises a mounting structure adapted to mount an accessory, a visor coupled to the helmet body, and an accessory mount adapted to support the accessory. The visor comprises a main body and a visor opening aligned with the mounting structure. The accessory mount is positioned at least partially in the visor opening and engaged with the mounting structure. The helmet body may include an impact-absorbing layer, and the mounting structure may be recessed in the impact-absorbing layer. The helmet body may include an outer shell covering at least a portion of the impact-absorbing layer, and the outer shell may include a shell opening aligned with both the mounting structure and the visor opening. The visor may include a recessed ledge around at least a portion of the visor opening, the recessed ledge supporting at least a portion of the accessory mount. The accessory mount may include an upper surface that is substantially flush with an upper surface of the main body of the visor. The accessory mount may include a ledge extending upward from the upper surface. The accessory mount may include an elongated track and an adjustable mount movable relative to the elongated track. The adjustable mount may include a pawl movable between an engaged position that inhibits movement of the adjustable mount relative to the elongated track and a disengaged position that permits movement of the adjustable mount relative to the elongated track. The elongated track may include a plurality of recesses that are spaced along a longitudinal direction of the elongated track. The pawl of the adjustable mount may be sized to engage with one of the recesses of the elongated track to secure the adjustable mount in the engaged position. The helmet body may have an outer surface adjacent the mounting structure, the outer surface defining a tangential plane, and the mounting structure may include an upper mount portion having an upper width parallel to the tangential plane, and a lower mount portion having a lower width parallel to the tangential plane, the lower width being larger than the upper width.

Referring now to an illustrated embodiment, FIG. 1 illustrates a bicycle helmet 10 having a helmet body 14 adapted to cover at least a portion of a rider's head, a visor 18 coupled to the helmet body 14, and an accessory mount 22 coupled to the helmet body 14 to support an accessory 26 (e.g., a camera, a light, etc.). The visor 18 includes a main body 20 that may be coupled to the helmet body 14 via a standard connection method (e.g., fasteners, a protrusion that engages a recess in the helmet body 14, etc.).

Figure 4:
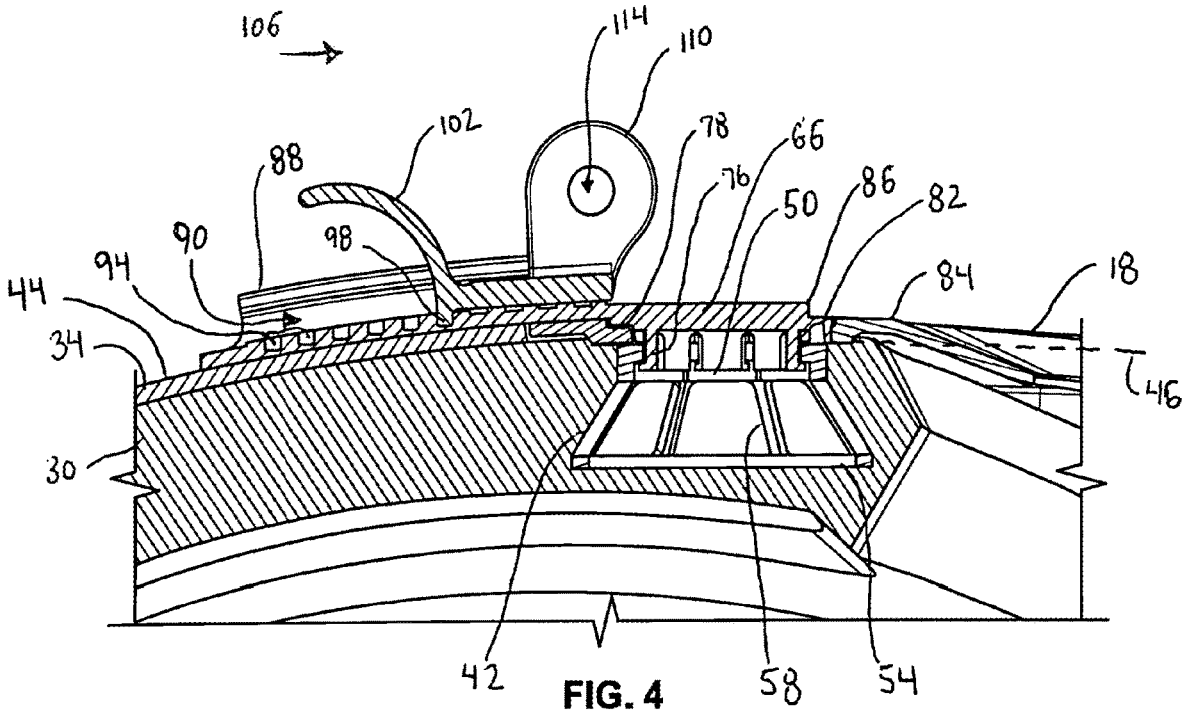
FIG. 4 is a cross-sectional view of a portion of the bicycle helmet of FIG. 1 taken along line 4-4 in FIG. 1 and illustrating the accessory mount coupled to the mounting structure.

As illustrated in FIG. 4, the helmet body 14 may include an impact absorbing layer 30 and an outer shell 34 covering the impact absorbing layer 30. The impact absorbing layer 30 may be formed of a material such as expanded polystyrene (EPS) or the like. The outer shell 34 may be formed of a material such as polycarbonate, carbon fiber, or the like.

Figure 2:
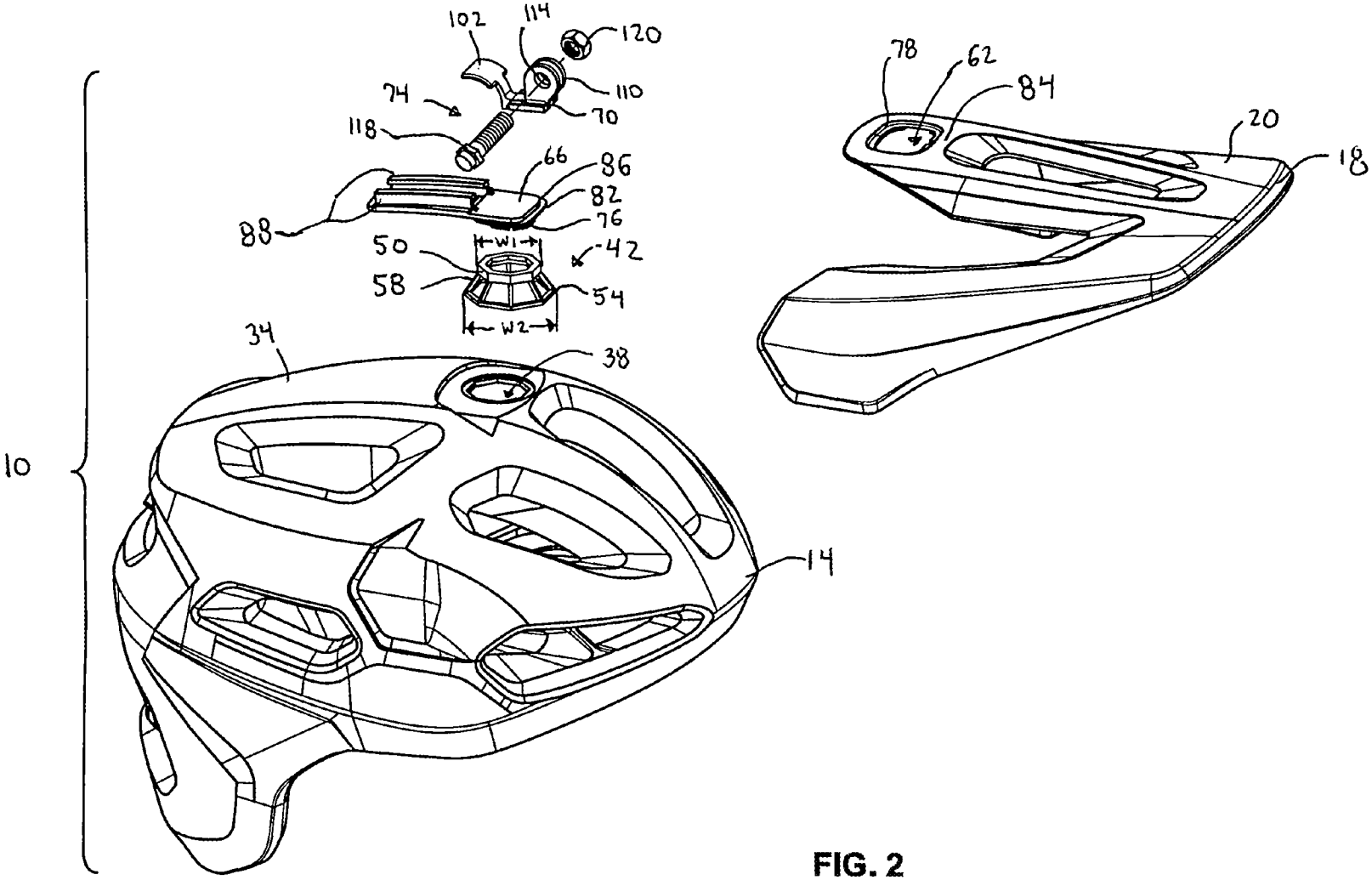
FIG. 2 is a perspective, exploded view of the bicycle helmet of FIG. 1.

As illustrated in FIGS. 2 and 4, the outer shell 34 may have an outer surface 44 (FIG. 4). The outer surface 44 may define a tangential plane 46 (FIG. 4) and include a shell opening 38 that is sized to receive a mounting structure 42. The mounting structure 42 may be positioned within the shell opening 38 (e.g., adjacent the outer surface 44) and may be recessed in the impact absorbing layer 30. In the illustrated embodiment, the mounting structure 42 includes an upper mount portion 50 having an upper width W1 (FIG. 2) parallel to the tangential plane 46 and a lower mount portion 54 having a lower width W2 (FIG. 2) parallel to the tangential plane 46. The lower width W2 is larger than the upper width W1. In the illustrated embodiment, the upper and lower mount portions 50, 54 have an octagonal shape. In other embodiments, the upper and lower mount portions 50, 54 may have an alternative geometry (e.g., circular, rectangular, etc.). In the illustrated embodiment, the mounting structure 42 further includes a plurality of spaced-apart finger portions 58 extending between and connecting the upper and lower mount portions 50, 54. In other embodiments, the mounting structure 42 may include, for example, a continuous structure extending between the upper and lower mount portions 50, 54.

Figure 3:
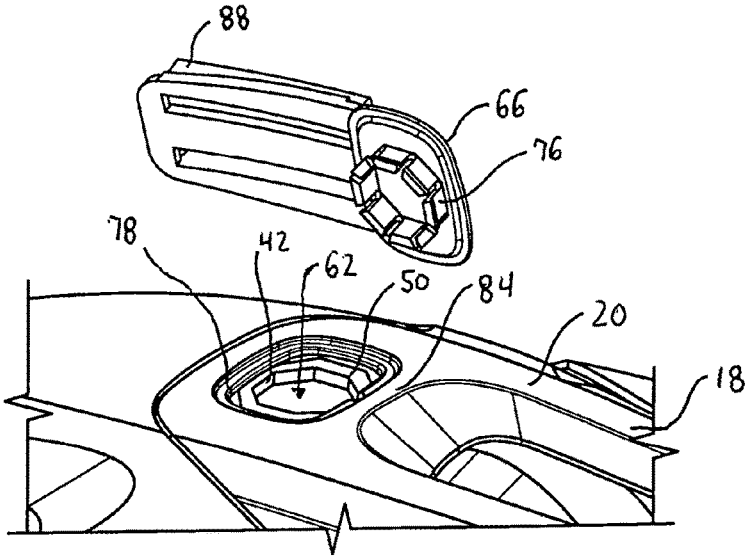
FIG. 3 is a perspective, exploded view of a portion of the bicycle helmet of FIG. 1 illustrating a mounting structure and an accessory mount.

With reference to FIGS. 2-4, the visor 18 may include a visor opening 62 aligned with the shell opening 38 and the mounting structure 42. Such positioning of the visor opening 62 facilitates access to the mounting structure by the accessory mount 22. In the illustrated embodiment, the visor 18 further includes a recessed ledge 78 around at least a portion of the visor opening 62.

The accessory mount 22 may at least partially extend through the visor opening 62 and engage with the mounting structure 42 to secure the accessory mount 22 to the helmet body 14. In the illustrated embodiment, the accessory mount 22 includes an elongated track 66, an adjustable mount 70 that is movable relative to the elongated track 66, and a fastener assembly 74 that secures the accessory 26 to the adjustable mount 70. The elongated track 66 may include a securing structure 76 (FIG. 3) formed on a lower surface of the elongated track 66 that engages the upper mount portion 50. In the illustrated embodiment, the securing structure 76 includes a plurality of segmented structures (e.g., detents) that form a heptagonal shape and selectively engage the upper mount portion 50 (FIG. 4) to secure the elongated track 66 to the helmet body 14. Other embodiments may include other securing structures, including other numbers and arrangements of segmented structures than that illustrated. When engaged with the mounting structure 42, a portion of the elongated track 66 is positioned in a recess formed by the recessed ledge 78 of the visor, and thus the recessed ledge 78 supports at least a portion of the accessory mount 22 (e.g., a portion of the elongated track 66). When the elongated track 66 of the accessory mount 22 is secured to the helmet body 14, an upper surface 82 of the accessory mount 22 may be substantially flush with an upper surface 84 of the main body 20 of the visor 18. In the illustrated embodiment, the elongated track 66 includes a ledge 86 extending from the upper surface 82. During removal of the elongated track 66 from the mounting structure 42, the user may provide a force on the ledge 86, which deforms the securing structure 76 and moves the securing structure 76 out of engagement from the recessed ledge 78. Alternatively, for example, the user may grasp an opposing, free end of the elongated track 66 and pivot the elongated track 66 upwards (e.g., away from the helmet body 14) to remove the elongated track 66 from the mounting structure 42.

Figure 8:
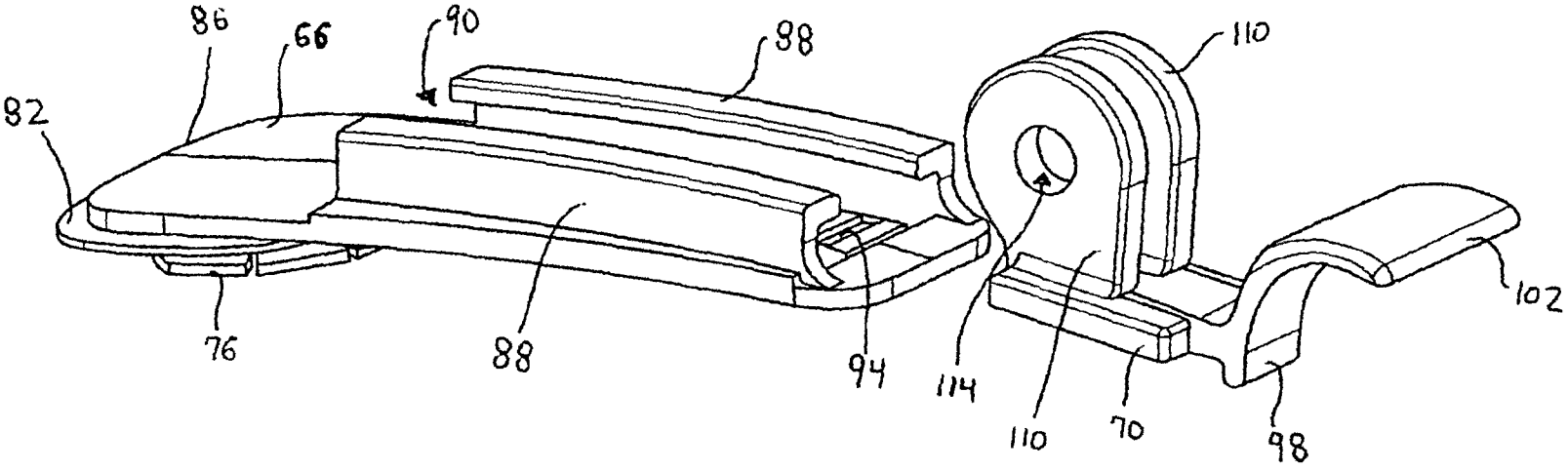
FIG. 8 is a perspective view of the accessory mount.
Figure 9:
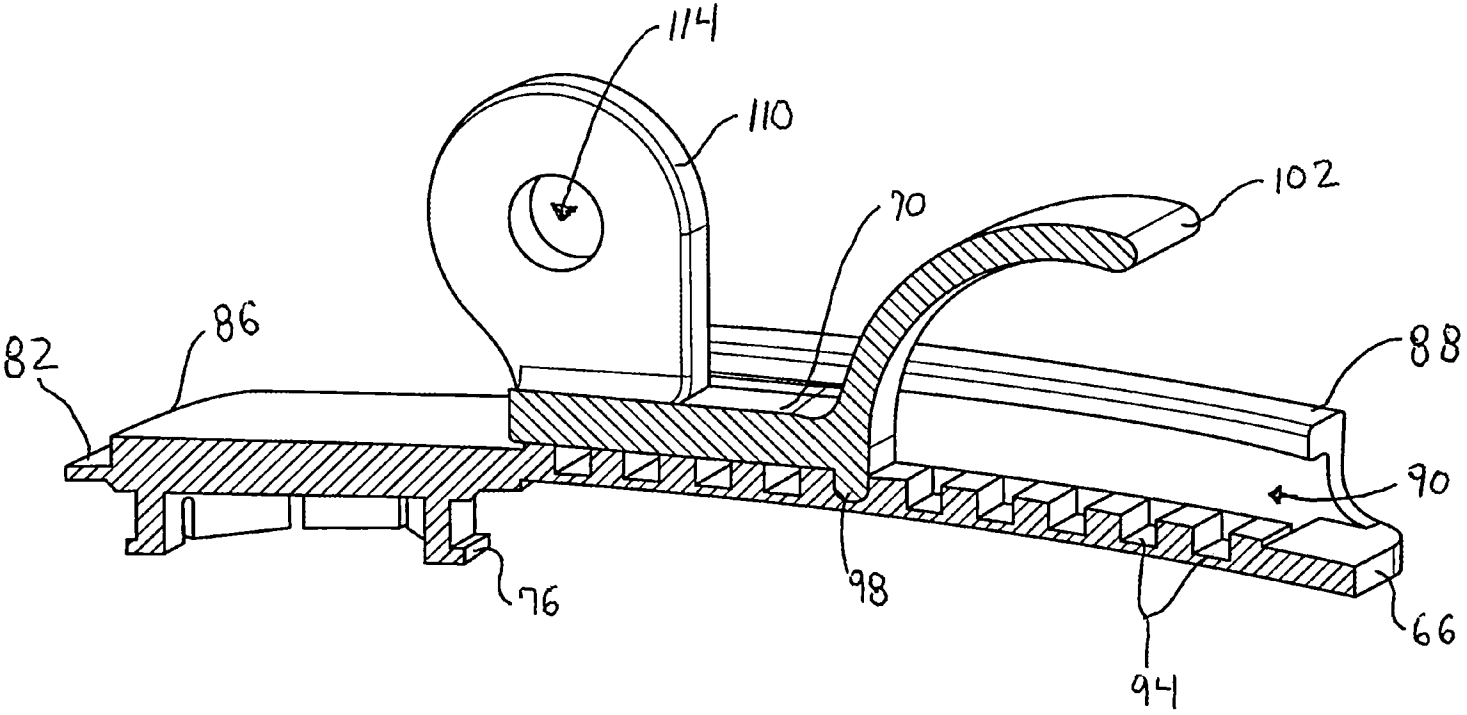
FIG. 9 is a cross-sectional view of the accessory mount.
Figure 10:
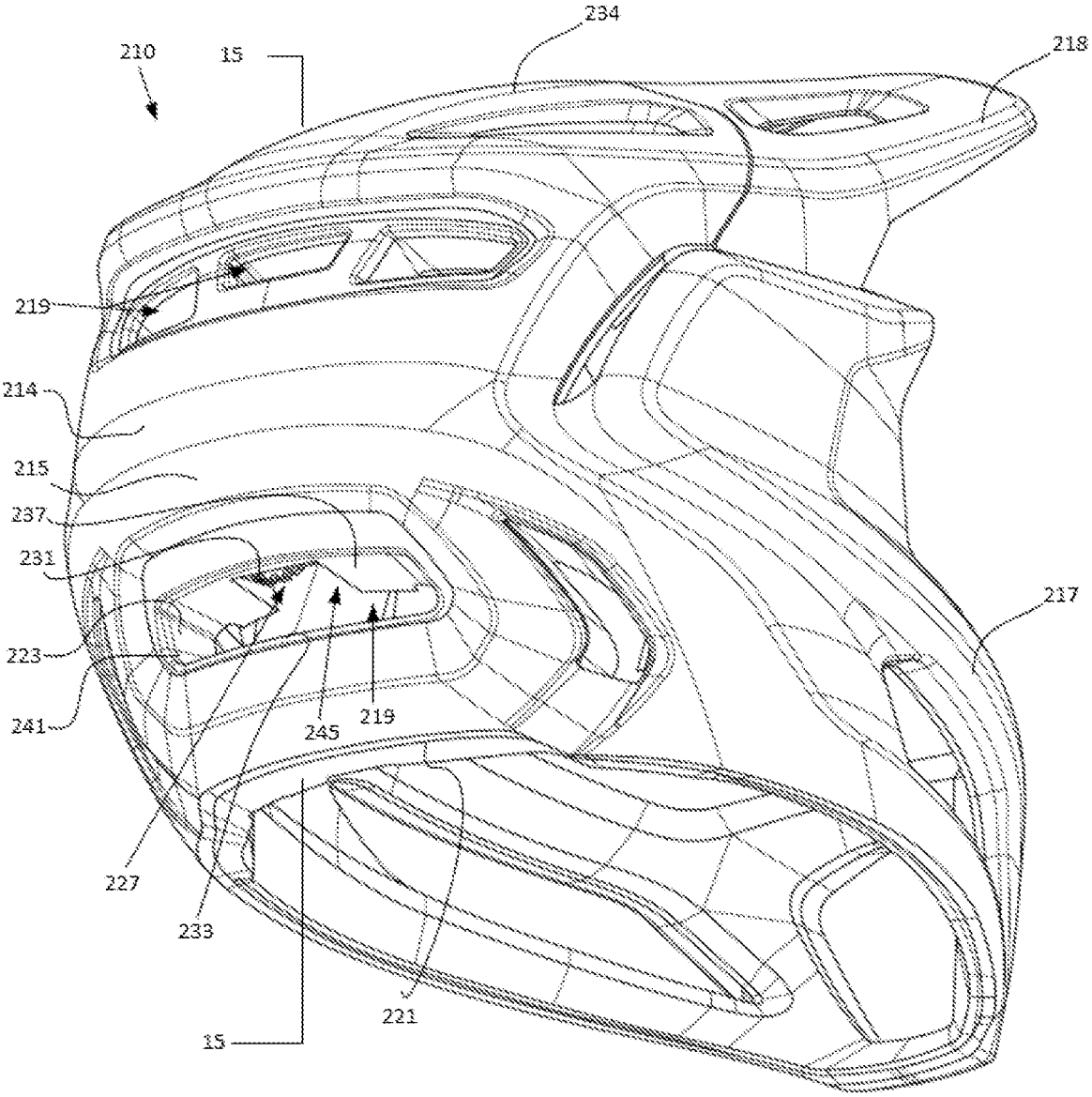
FIG. 10 is a perspective view of a bicycle helmet according to an embodiment, including an adjusting assembly coupled to the helmet.
Figure 11:
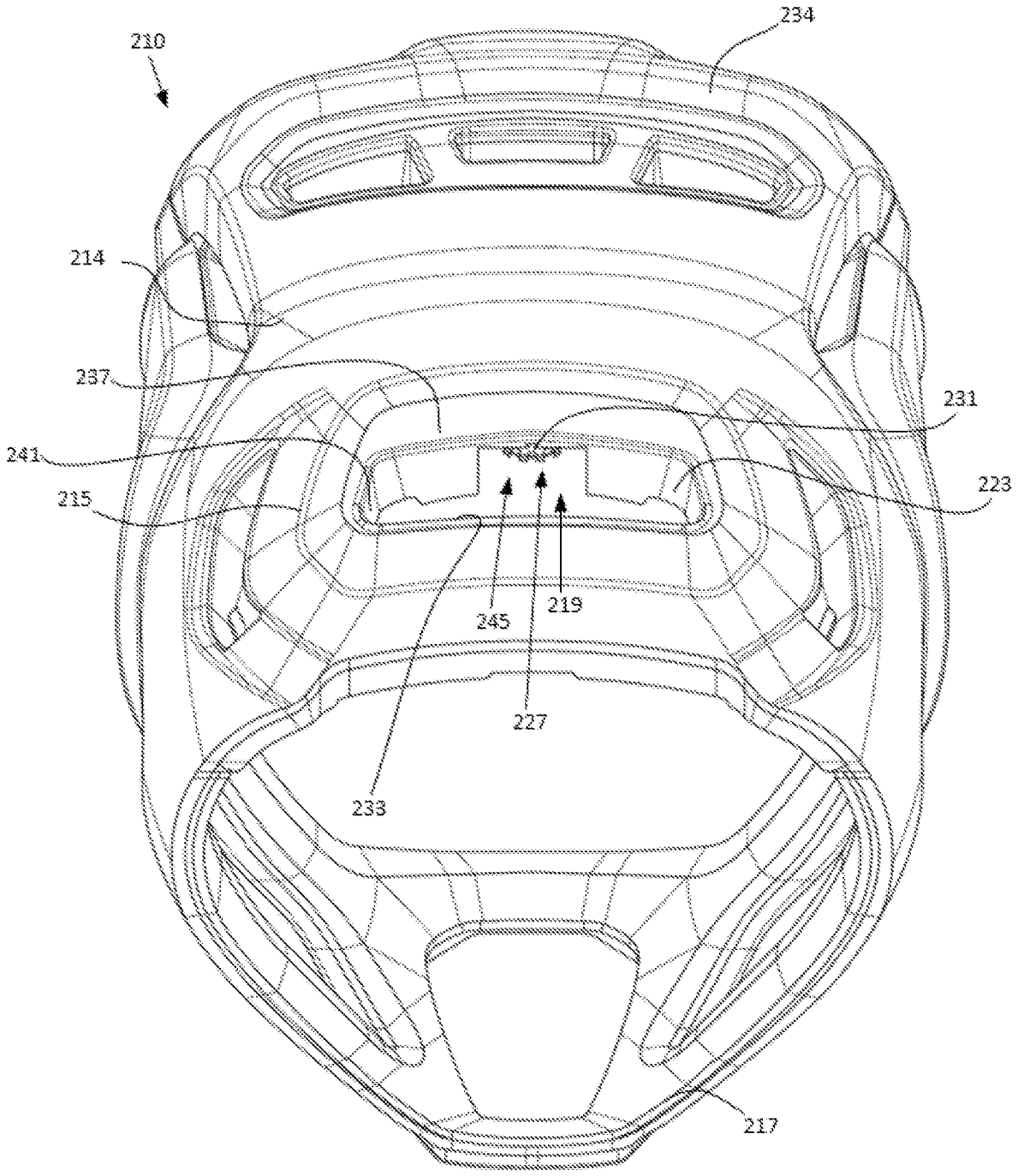
FIG. 11 is a rear view of the bicycle helmet of FIG. 10, illustrating an adjusting input of the adjusting assembly positioned within a vent of the helmet.

Referring to FIGS. 4, 8, and 9, the elongated track 66 may include rail portions 88 extending from the upper surface 82 and spaced from each other to define a receiving channel 90 that selectively receives the adjustable mount 70. The receiving channel 90 may include a plurality of recesses 94 that are sized to receive a pawl 98 of the adjustable mount 70. In the illustrated embodiment, the recesses 94 are spaced from each other in a longitudinal direction of the elongated track 66 so the adjustable mount 70 can be positioned in a plurality of positions with respect to the elongated track 66. The pawl 98 of the adjustable mount 70 is movable between an engaged position, where the pawl 98 engages one of the recesses 94 (FIGS. 4 and 9), that inhibits movement of the adjustable mount 70 relative to the elongated track 66 and a disengaged position, where the pawl 98 is disengaged with the recesses 94, that permits movement of the adjustable mount 70 relative to the elongated track 66.

The adjustable mount 70 may include an extension 102 coupled to the pawl 98. In the illustrated embodiment, the extension 102 has a half-circle geometry and extends upward between the rail portions 88 of the elongated track 66. The extension 102 is designed to be pivoted relative to the elongated track 66 (e.g., in the direction 106), which causes the pawl 98 to disengage from the recesses 94. Other embodiments may include shapes other than the half-circle shape illustrated.

With continued reference to FIGS. 4 and 8, the adjustable mount 70 may further include mounting portions 110 that are spaced from the pawl 98. In the illustrated embodiment, the mounting portions 110 each include an aperture 114 sized to receive the fastener assembly 74 (FIGS. 1 and 2) to secure the accessory 26 to the adjustable mount 70. The accessory 26 includes a connection portion 116 that has an aperture that is designed to be aligned with the apertures 114. In the illustrated embodiment, the fastener assembly 74 includes a bolt 118 that extends through the apertures 114 of the mounting portions 110 and the connection portion 116 and a nut 120 that engages the bolt 118.

Figure 5:
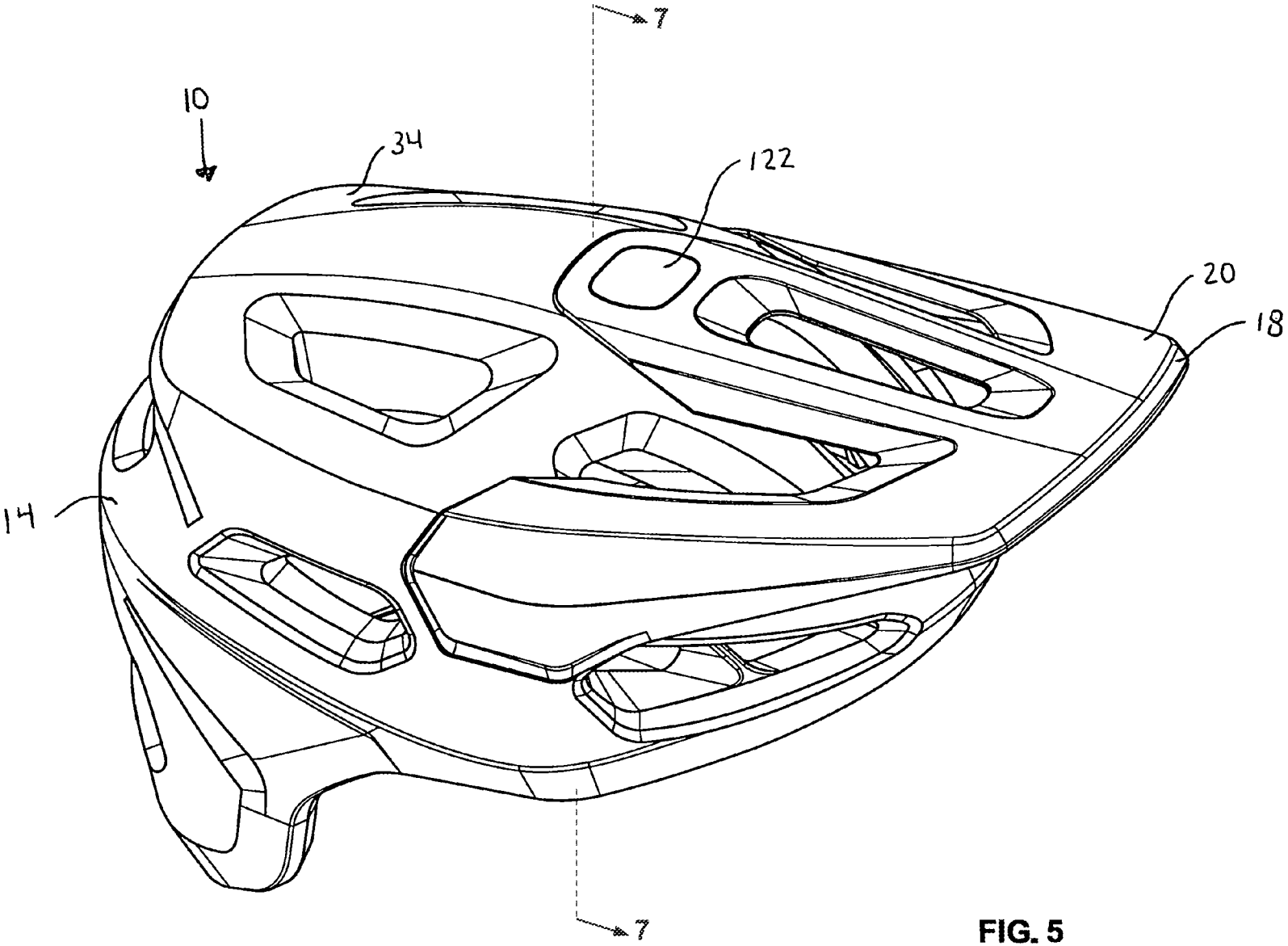
FIG. 5 is a perspective view of the bicycle helmet of FIG. 1 with the accessory mount removed and a removable panel covering the mounting structure.
Figure 6:
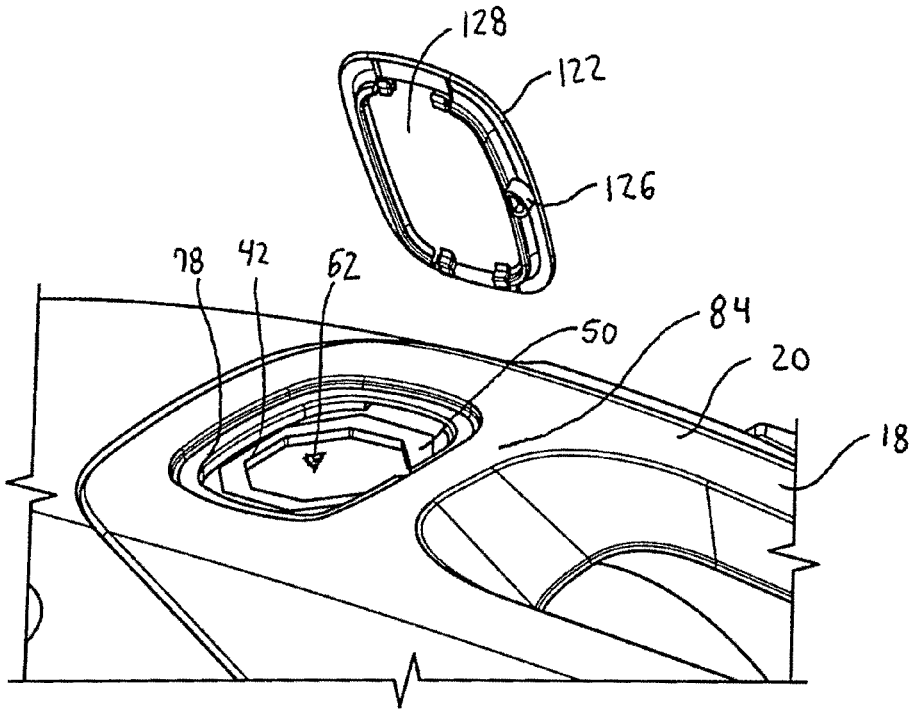
FIG. 6 is a perspective, exploded view of a portion of the bicycle helmet of FIG. 5 illustrating the mounting structure and the removable panel in an exploded position.
Figure 7:
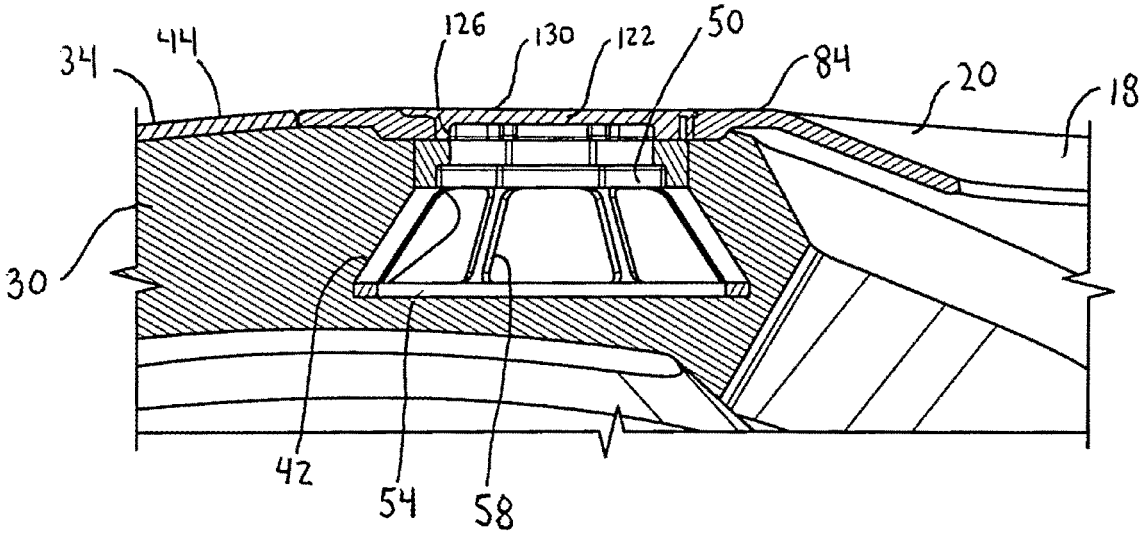
FIG. 7 is a cross-sectional view of a portion of the bicycle helmet of FIG. 5 taken along line 7-7 in FIG. 5 illustrating the removable panel coupled to the helmet.

Referring to FIGS. 5-7, the helmet 10 may further include a removable panel 122 that can be removably secured to the main body 20 of the visor 18 in place of the accessory mount 22. The removable panel 122 provides a cover for the visor opening 62 when the accessory mount 22 is not being used. The removable panel 122 may include a connection structure 126 (e.g., lip or groove, etc.) formed on a lower surface 128 of the panel 122 that is sized to engage with the recessed ledge 78 formed around the visor opening 62 (e.g., such that the recessed ledge 78 supports the removable panel 122). In other embodiments, the removable panel 122 may be secured to the helmet through engagement with the mounting structure 42. When the removable panel 122 is secured to the helmet 10, an upper surface 130 (FIG. 7) of the removable panel 122 may be substantially flush with the upper surface 84 of the main body 20 of the visor 18. In some embodiments, the removable panel 122 may include a feature (e.g., recess formed on the upper surface 130 or a ledge (or other protrusion) that extends upwards from the upper surface 130) for the user to grasp or otherwise engage during removal of the panel 122.

During use, the removable panel 122 may be coupled to the recessed ledge 78 of the visor 18 to cover the mounting structure 42 and enclose the visor opening 62. In order to secure the accessory mount 22 to the helmet 10, the removable panel 122 may be disengaged from the recessed ledge 78 to provide access to the mounting structure 42. The accessory mount 22 may then be attached to the mounting structure 42 through the visor opening 62. In the illustrated embodiment, the securing structure 76 of the elongated track 66 extends through the visor opening 62 and engages the upper mount portion 50 of the mounting structure 42. The adjustable mount 70 may be inserted within the receiving channel 90 of the elongated track 66 and moved to a desired position. For example, the user may grasp the extension 102 and pivot the extension 102 and the pawl 98 relative to the elongated track 66 (e.g., in the direction 106). When the adjustable mount 70 is in a desired position, the extension 102 may be released so the pawl 98 engages with one of the recesses 94, which inhibits movement of the adjustable mount 70 relative to the elongated track 66. To remove the accessory mount 22, the user may grasp the ledge 86 to disengage the securing structure 76 of the elongated track 66 from the mounting structure 42. Once the accessory mount 22 is removed, the removable panel 122 may be coupled to the recessed ledge 78 of the visor 18 to cover the mounting structure 42 and enclose the visor opening 62.

FIGS. 10-15 illustrate a bicycle helmet 210. The bicycle helmet 210 is like the bicycle helmet 10 shown in FIGS. 1-9 and described above. Therefore, like features are identified with like reference numerals plus "200", and only the differences between the two will be discussed.

The bicycle helmet 210 includes a helmet body 214 adapted to cover at least a portion of a rider's head. The helmet body 214 may include a wall portion 215 having an impact absorbing layer 230 (FIG. 15) and an outer shell 234 covering the impact absorbing layer 230. In the illustrated embodiment, the helmet body 214 includes a lower portion 217 (FIG. 12) that encloses an interior portion of the helmet 210 and that may provide up to 360-degree protection for the rider's head (e.g., around the user's chin). In other embodiments the lower portion 217 does not extend around a user's chin. As illustrated in FIGS. 10-15, one or more vents 219 may extend through the wall portion 215 from an exterior of the helmet body 214 to the interior of the helmet body 214. The vents 219 may be defined at least partially by one or more vent surfaces 223 that extend between the interior and exterior of the helmet body 214. In the illustrated embodiment, a vent 219 is positioned along a rear portion of the helmet and above a drip line 221 (i.e., the lowest line of coverage of the helmet 210 as seen in FIGS. 14 and 15). A vent surface 223 defines an outer boundary of the vent 219 and at least partially encloses each side of the vent 219. In the illustrated embodiment, the vent 219 has a generally rectangular cross-sectional shape (FIG. 13), although embodiments may include shapes and sizes other than that illustrated.

Figure 12:
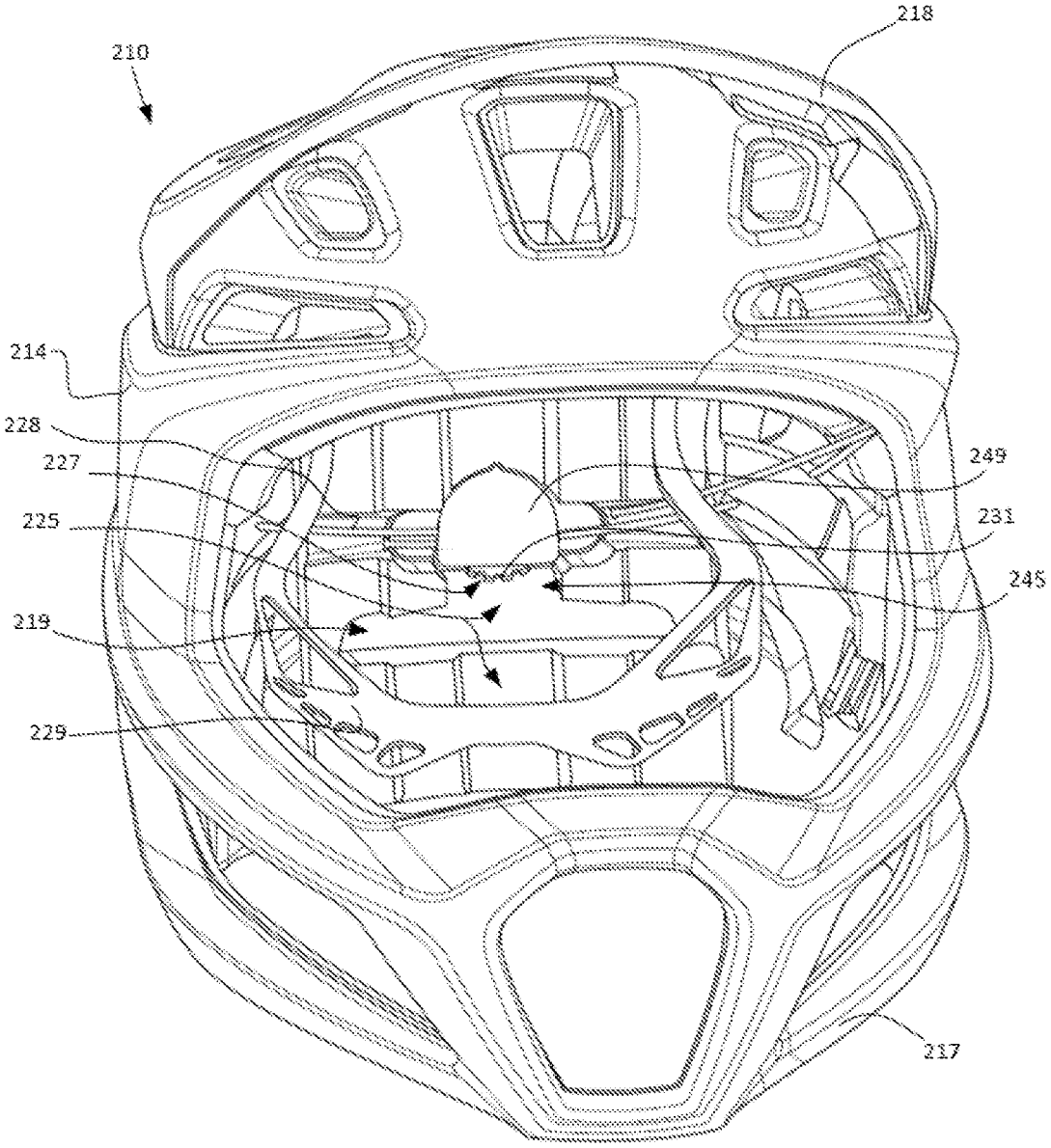
FIG. 12 is a front view of the bicycle helmet of FIG. 10 illustrating the adjusting assembly.

With reference to FIG. 12, an adjusting assembly 225 may be positioned at least partially in the vent 219 and positioned above the drip line 221 of the helmet 210. The adjusting assembly 225 may be used to decrease or increase an internal volume of the helmet 210 to create a tighter or looser fit. In the illustrated embodiment, the adjusting assembly 225 includes an adjusting input 227 coupled to a strap member 229 that is positioned within the helmet body 214 to wrap at least partially around a user's head. The adjusting input 227 may be fixed to the helmet body 214 and may include, for example, a rotating dial 231 that is coupled to the helmet body 214. In some embodiments, the adjusting input 227 is embedded at least partially within the impact absorbing layer 230 and is positioned within the vent 219 on a rear, lower portion (FIG. 11) of the helmet body 214. In other embodiments, the adjusting input 227 may be coupled to the helmet body 214 in an alternative fashion (e.g., via a fastener), may be located outside of the impact absorbing layer 230, or the like. A portion 228 of the strap member 229 may be coupled to the adjusting input 227 and may be adjustable relative to the helmet body 214 via the adjusting input 227. In the illustrated embodiment, rotation of the dial 231 of the adjusting assembly 225 causes the strap member 229 to displace, which may cause a change in the shape of an internal volume defined by the helmet 210 (e.g., to tighten or loosen the helmet on the user' head). In some embodiments, the dial 231 may be coupled to the portion 228 of the strap member 229 in a similar fashion as the adjustment mechanisms described in U.S. Pat. No. 8,015,625 filed on May 6, 2009 or U.S. Pat. No. 10,420,385 filed on, Apr. 25, 2014, the entire contents of which are incorporated herein by reference.

Figure 13:
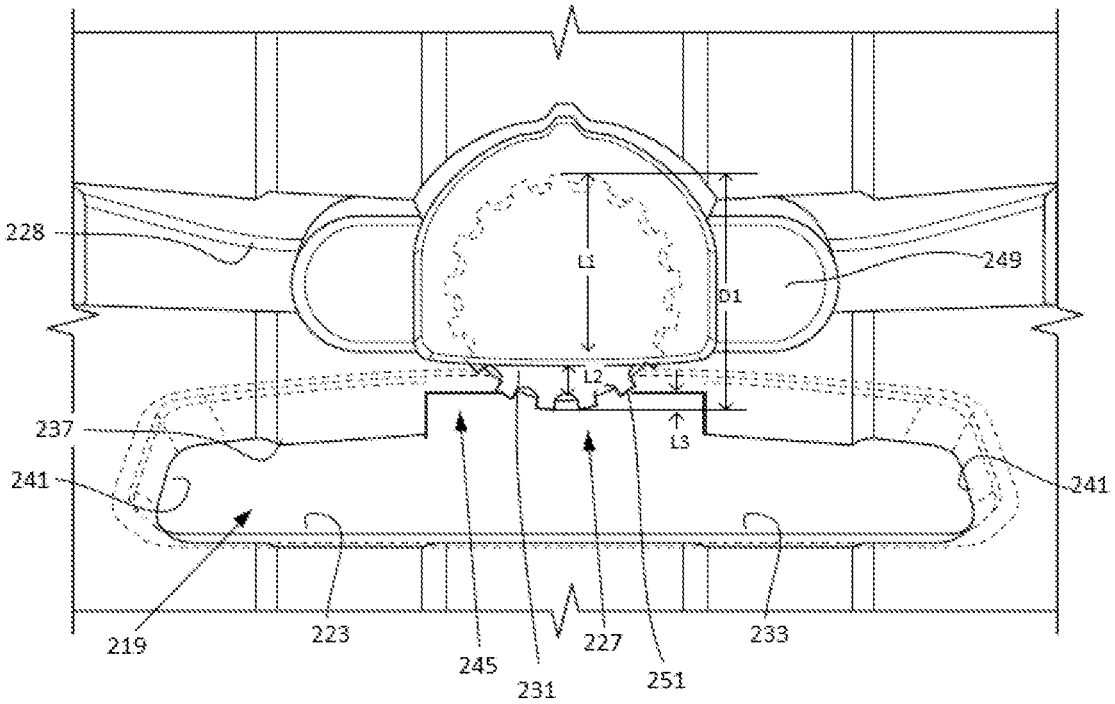
FIG. 13 is an isolated front view of the adjusting assembly of FIG. 12.
Figure 14:
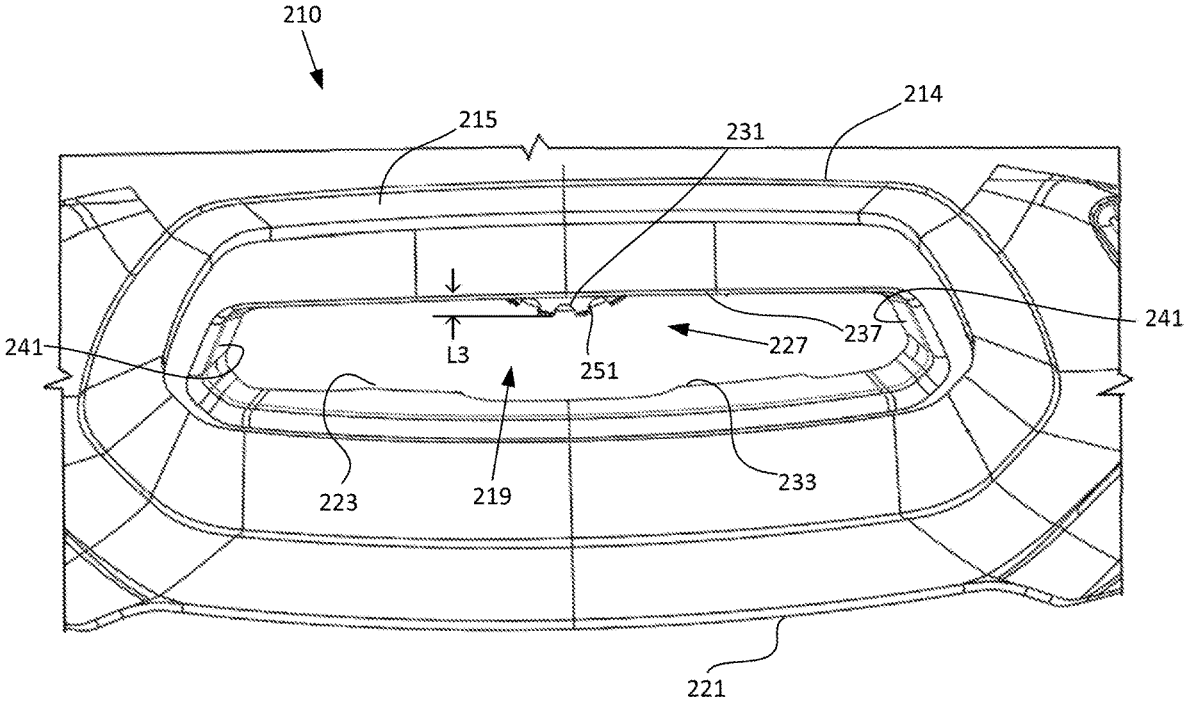
FIG. 14 is an isolated rear view of the bicycle helmet of FIG. 10 illustrating the adjusting assembly.
Figure 15:
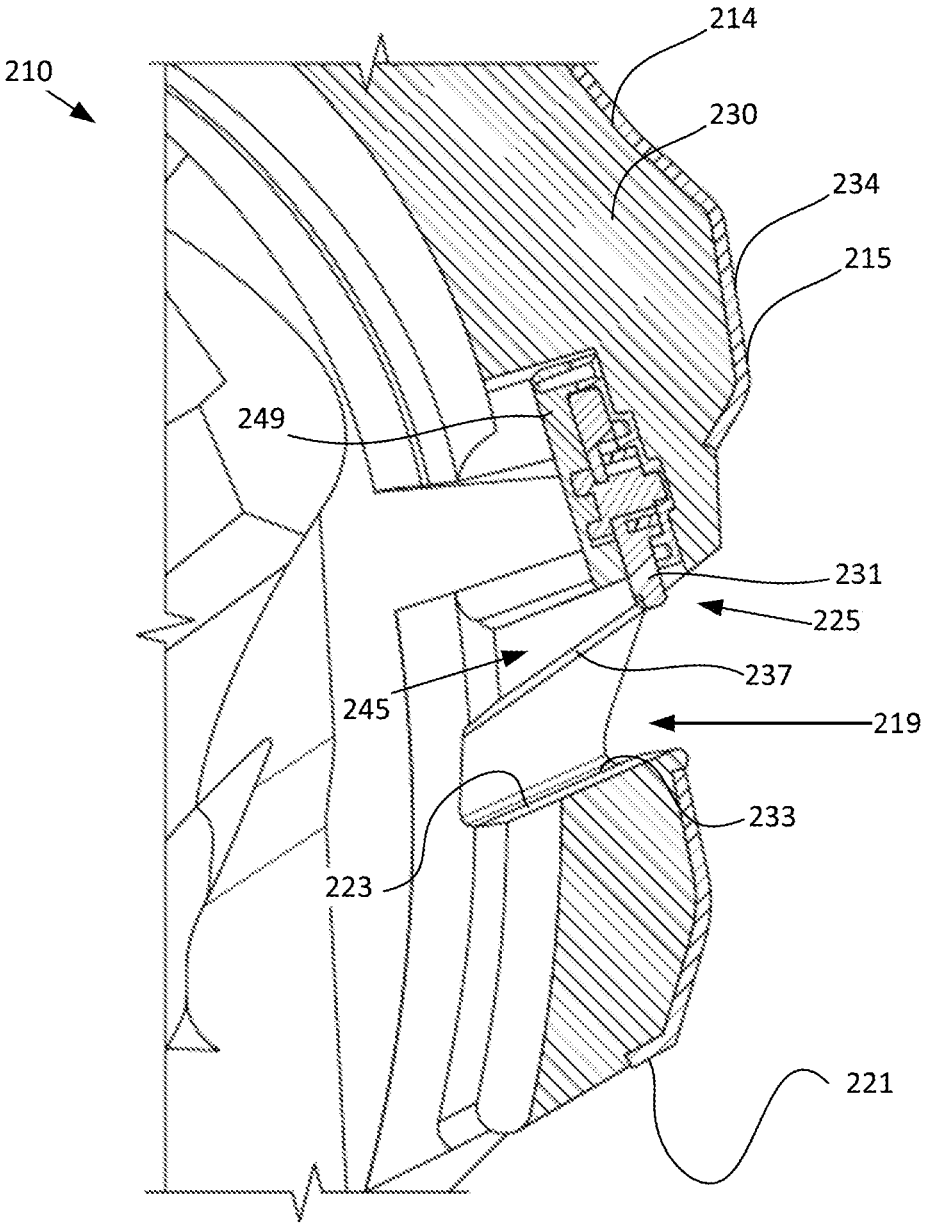
FIG. 15 is a cross-sectional view of a portion of the bicycle helmet of FIG. 10 taken along line 15-15 in FIG. 10 and illustrating the adjusting assembly.
Figure 16:
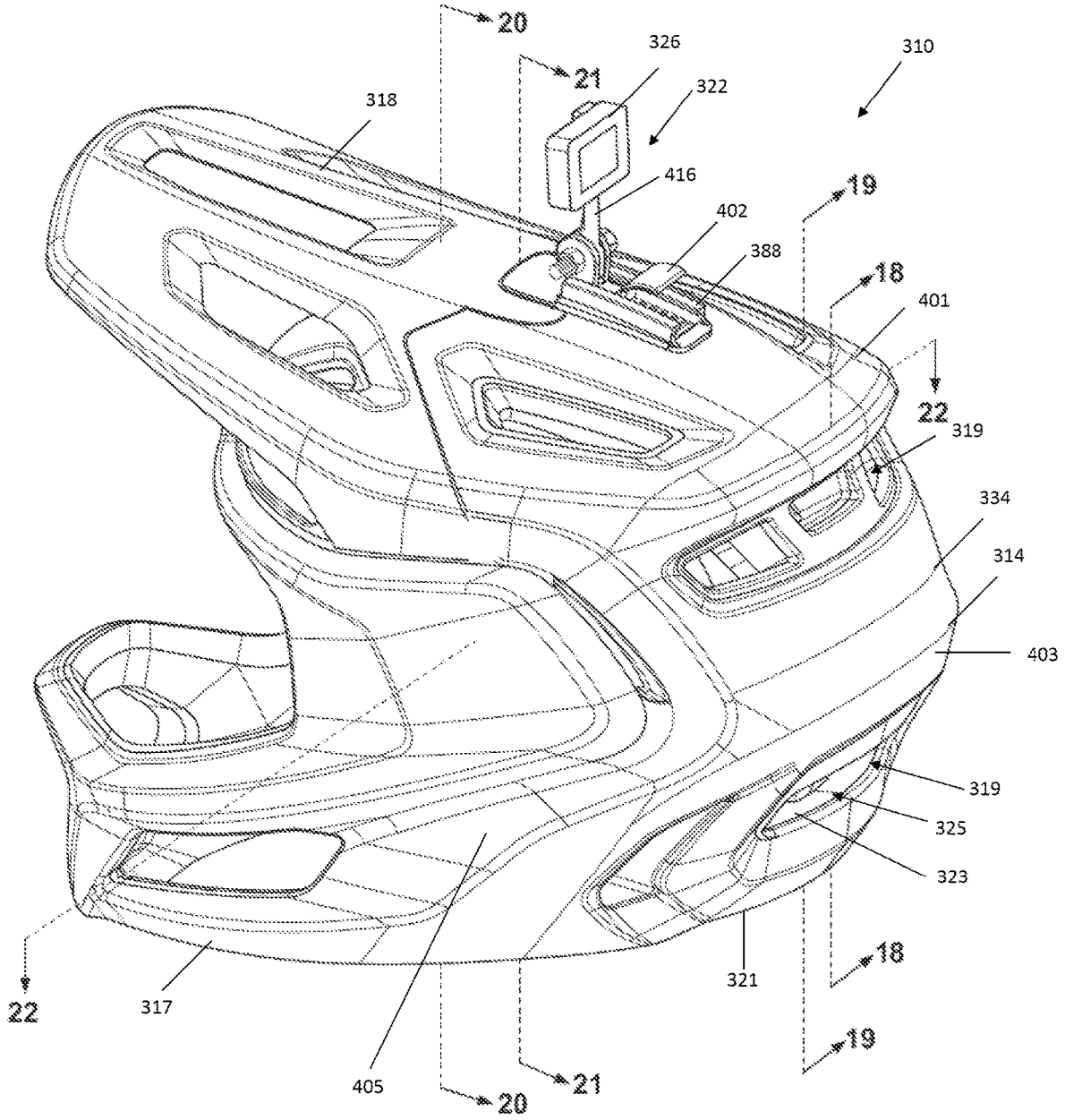
FIG. 16 is a perspective view of a bicycle helmet according to an embodiment, including an accessory mounted to the helmet, an adjusting assembly coupled to the helmet, and multiple impact absorbing structures.

With reference to FIGS. 13-15, the vent surface 223 may define a lower vent surface 233, an upper vent surface 237, and side vent surfaces 241, which together at least partially enclose the vent 219. The upper vent surface 237 may be angled relative to the lower vent surface 233 (FIG. 15). For example, the upper vent surface 237 may taper toward the lower vent surface 233 as the upper vent surface 237 extends from the exterior of the helmet body 214 toward the interior of the helmet body 214. The lower vent surface 233 may taper toward the upper vent surface 237 as the lower vent surface 233 extends from the exterior of the helmet body 214 toward the interior of the helmet body 214. The upper vent surface 237 may also at least partially define a recess 245 (FIGS. 13 and 15) that is sized to receive at least a portion of the adjusting input 227 of the adjusting assembly 225. In some embodiments, the recess 245 is a recess located within the impact absorbing layer 230. In some embodiments, the recess 245 may be positioned on the lower vent surface 233 or the side vent surface 241. It should be appreciated that in some embodiments the recess 245 may be considered a portion of, or extension of, the vent 219.

With reference to FIGS. 12, 13, and 15, the adjusting assembly 225 may include an adjusting housing 249 that may rotationally support the rotating dial 231 of the adjusting input 227 and may be at least partially (e.g., fully) positioned within the recess 245. The dial 231 may have a plurality of protrusions 251 spaced circumferentially around the dial 231. In the illustrated embodiment, the protrusions 251 define surfaces for the user to grasp during rotation of the dial 231. As illustrated in FIG. 13, the dial 231 may have a diameter D1 defined between opposing protrusions on the dial 231. The dial 231 may further have a first portion (e.g., that is disposed within the housing 249) defined by a length L1, a second, recessed portion (e.g., that is disposed outside of the housing 249 and within the recess 245) defined by a length L2, and a third, exposed portion (e.g., that is disposed outside of the housing 249) defined by a length L3. In the illustrated embodiment, the first portion of the dial 231 is positioned within the adjusting housing 249, the second, recessed portion is positioned within the recess 245, and the third, exposed portion is positioned within the vent 219 (FIG. 14). In other words, only a small portion of the dial 231 is visible when the helmet 210 is viewed from the rear (FIG. 14). In other embodiments, the second and third portions of the dial 231 may together form a single exposed portion that is visible from a rear view of the helmet 210. In yet other embodiments, the dial 231 may include no portions that are exposed within the vent 219 from a rear view (FIG. 14) of the helmet. Rather, the entire dial 231 may be hidden or otherwise blocked from view when viewing the helmet 210.

In some embodiments, the length L1 of the first portion of the dial 231 is in a range of 60%-75% of the diameter D1 of the dial 231. The length L2 of the second, recessed portion of the dial 231 is in a range of 5%-30% of the diameter D1. The length L3 of the third, exposed portion of the dial 231 is in a range of 1%-15% of the diameter D1. In the illustrated embodiment, the length L1 of the first portion is approximately 70% of the diameter D1, the length L2 of the second, recessed portion is approximately 20% of the diameter D1, and the third, exposed portion is approximately 10% of the diameter D1. In some embodiments, only the protrusions 251 may form the third, exposed portion. In some embodiments, and as described above, the second and third portions of the dial 231 may together form a single exposed portion of the dial 231 that is positioned and visible within the vent 219 from a rear view of the helmet 210. In some embodiments, the overall exposed portion of the dial 231 may be in a range of 10%-40% of the diameter D1.

FIGS. 16-22 illustrate a bicycle helmet 310. The bicycle helmet 310 is like the bicycle helmet 10 shown in FIGS. 1-9 and described above and the bicycle helmet 210 shown in FIGS. 10-15 and described above. Therefore, like features are identified with like reference numerals plus "300", and only the differences between the two will be discussed.

Figure 20:
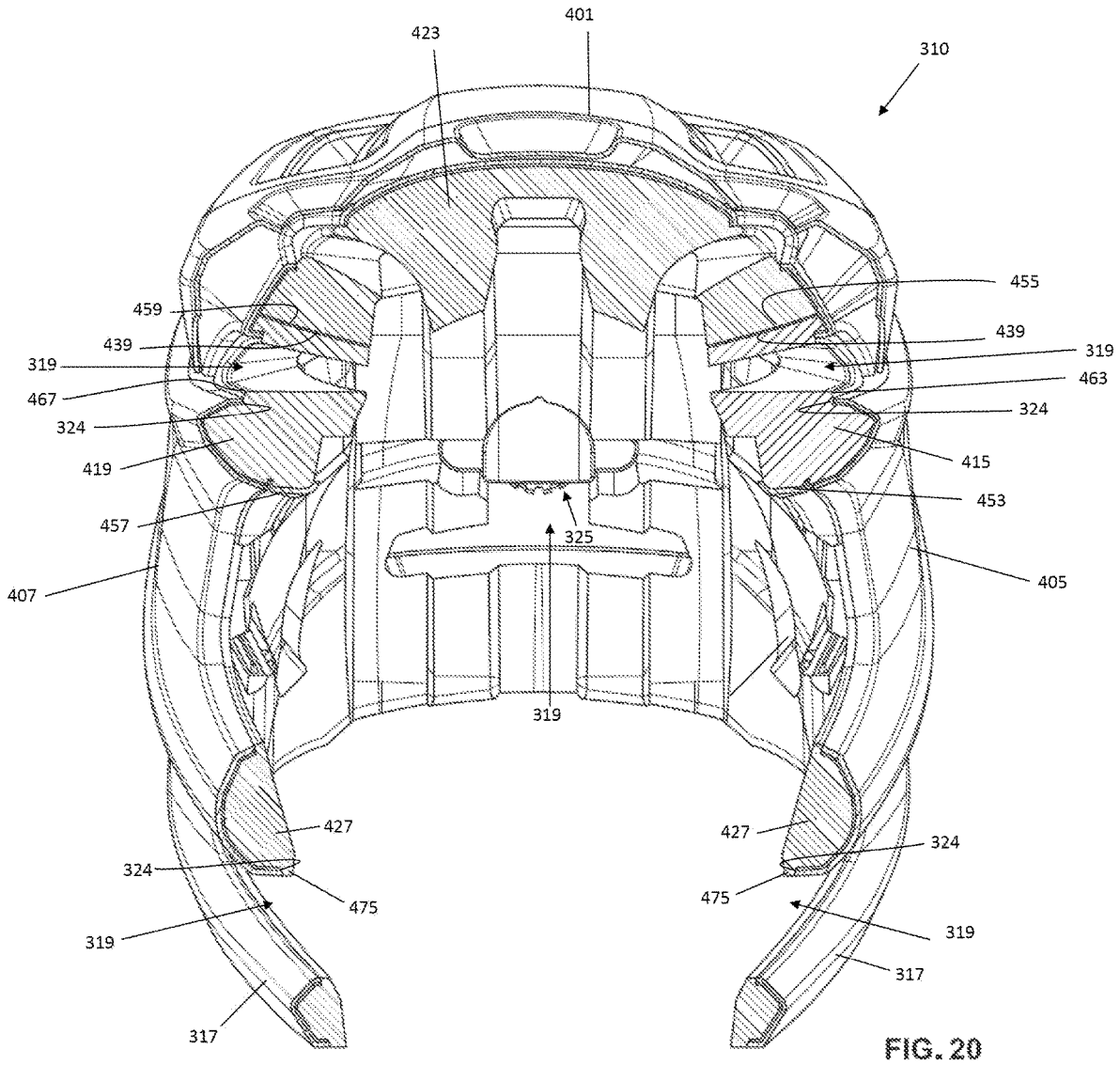
FIG. 20 is a front, cross-sectional view the bicycle helmet of FIG. 16 about the line 20-20 in FIG. 16, illustrating an interface of a left and a right impact absorbing structure with the outer shell of the helmet and the upper impact absorbing structure.

The bicycle helmet 310 includes a helmet body 314 adapted to cover at least a portion of a rider's head. The helmet body 314 may include an impact absorbing layer 330 (FIG. 17) and an outer shell 334 covering the impact absorbing layer 330. The outer shell 334 may define an upper wall 401, a rear wall 403, a left wall 405, and a right wall 407 (FIG. 20). In the illustrated embodiment, the helmet body 314 includes a lower (e.g., chin strap) portion 317 that encloses an interior portion of the helmet 310 and that may provide up to 360-degree protection for the rider's head (e.g., around the user's chin). In other embodiments, the helmet 310 may be devoid of the lower portion 317, similar to the helmet 10. The illustrated helmet 310 further includes a visor 318 coupled to the helmet body 314, an accessory mount 322, and an adjusting assembly 325. The accessory mount 322 extends through a visor opening 362 in the visor 318 and engages with a mounting structure 342 positioned within a shell opening 338 to support an accessory 326 (e.g., a camera, a light, etc.), similar to the accessory mount 22 described above with reference to FIGS. 1-9. The adjusting assembly 325 may be positioned at least partially in a vent 319, positioned above a drip line 321 of the helmet 310, and may be used to decrease or increase an internal volume of the helmet 210 to create a tighter or looser fit, similar to the adjusting assembly 225 described above with reference to FIGS. 10-15. In other embodiments the helmet 310 may not include the visor 318, the accessory mount 322, the adjusting assembly 325, and/or the impact absorbing layer 330.

Figure 17:
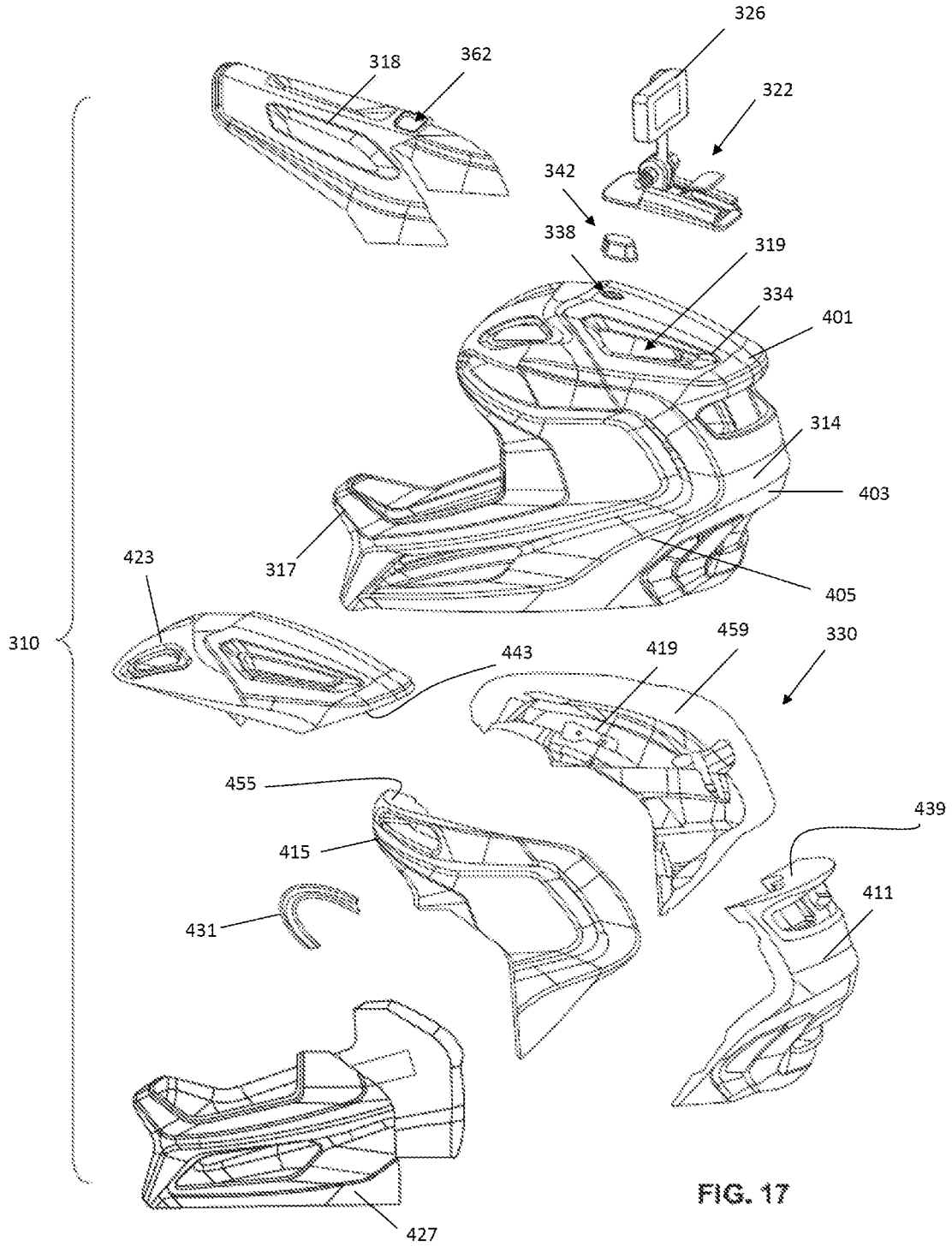
FIG. 17 is a perspective, exploded view of the bicycle helmet of FIG. 16 illustrating the multiple impact absorbing structures.

With reference to FIG. 17, in the illustrated embodiment the impact absorbing layer 330 includes a plurality of impact absorbing structures 411, 415, 419, 423, 427 that are coupled together (e.g., via lateral compression). As illustrated in FIGS. 17-22, the impact absorbing layer 330 may include a rear impact absorbing structure 411, a left impact absorbing structure 415, a right impact absorbing structure 419, an upper impact absorbing structure 423, and/or a lower, chin strap impact absorbing structure 427. In other embodiments, the impact absorbing layer 330 may be formed of more impact absorbing structures (e.g., 6, 7, etc.) or less impact absorbing structures (e.g., 4, 3, 2). Each impact absorbing structure 411, 415, 419, 423, 427 includes at least one interface that interacts with an interface of an adjacent impact absorbing structure through lateral compression to form the overall impact absorbing layer 330. It should be appreciated that such lateral compression may be formed by applying a compressive force and/or pressing one or more of the impact absorbing structures 411, 415, 419, 423, 427 laterally against an adjacent impact absorbing structure to secure the impact absorbing structures 411, 415, 419, 423, 427 together in a compressed state to form the overall impact absorbing layer 330.

With continued reference to FIG. 17, in some embodiments an additional connection structure 431 may extend between adjacent impact absorbing structures 411, 415, 419, 423, 427 to additionally mechanically secure the impact absorbing structures 411, 415, 419, 423, 427 together. In the illustrated embodiment, the additional connection structure 431 is arcuately shaped and engages a groove formed in each of the upper, left, and right impact absorbing structures 423, 415, 419 to form a snap-fit arrangement that helps to rigidly secure the impact absorbing structures 423, 415, 419 together. Other embodiments may include other types of additional connection structures 431 (e.g., straps, snaps, fasteners, etc.), or may include no additional connection structures 431. In addition, in some embodiments additional connection structures 431 may be used to secure the rear impact absorbing structure 411 and the chin strap impact absorbing structure 427 to the upper, left, and right impact absorbing structures 423, 415, 419. In some embodiments, and as noted above, the impact absorbing structures 411, 415, 419, 423, 427 may all be held together without any additional connection structures (e.g., may be held together entirely through lateral compression).

Figure 18A:
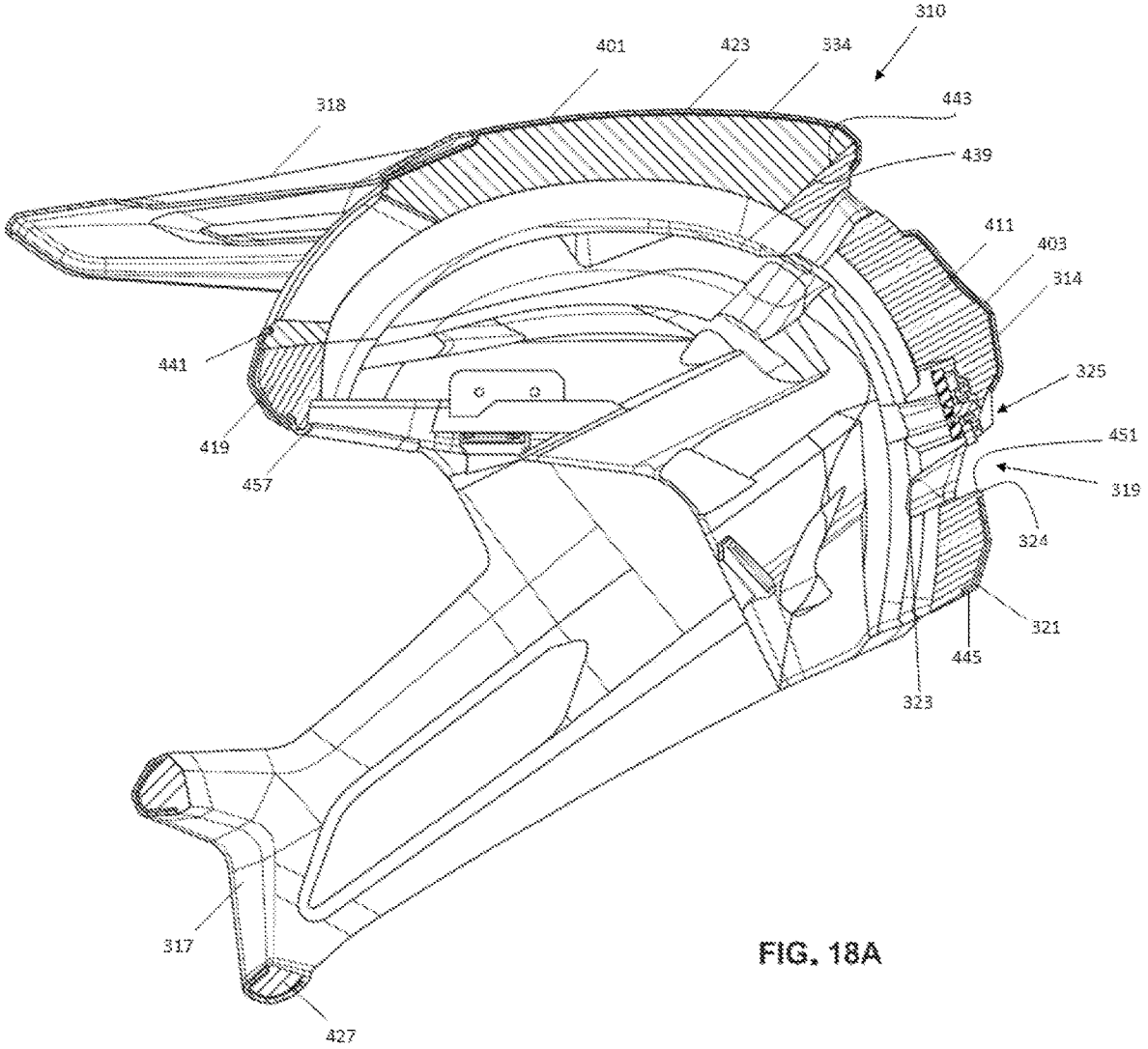
FIG. 18A is a side, cross-sectional view the bicycle helmet of FIG. 16 about the line 18-18 in FIG. 16, illustrating an interface of a rear impact absorbing structure with an upper impact absorbing structure and an outer shell of the helmet.

With reference to FIGS. 18A-22, the impact absorbing structures 411, 415, 419, 423, 427 may be secured to various receiving portions formed in the helmet body 314. The receiving portions may include, for example, one or more vents 319 formed in the outer shell 334, one or more recesses formed in the outer shell 334 (e.g. indentations or other recessed areas along an interior of the helmet 310 that do not extend entirely through the outer shell 334), and/or one or more recesses formed in an intermediate layer or inner shell 435 (FIG. 18B) positioned between the impact absorbing layer 330 and the outer shell 334. The vents 319 may be defined at least partially by one or more vent surfaces 323 that extend between the interior and exterior of the helmet body 314 and include a vent edge 324 (FIG. 18A). The recesses formed in the inner shell 435 or the outer shell 334 may only extend partially between the interior and exterior of the helmet body 314. As such, it should be appreciated that a receiving portion formed in the helmet body 314 may encompass any of the embodiments described above.

Figure 19:
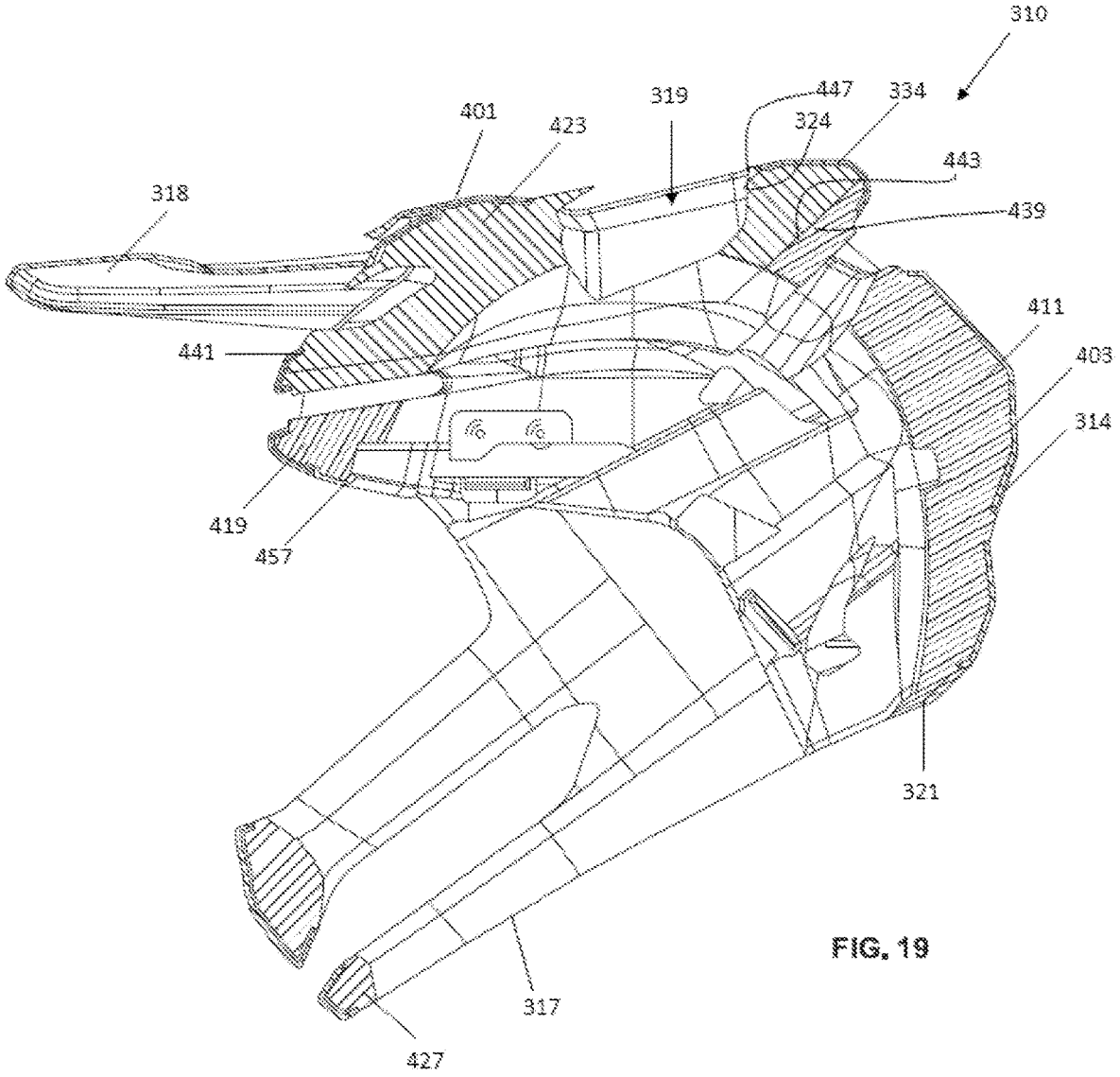
FIG. 19 is a side, cross-sectional view of the bicycle helmet of FIG. 16 about the line 19-19 in FIG. 16, illustrating an interface of the upper impact absorbing structure with the outer shell of the helmet.

With reference to FIGS. 18A and 19, in the illustrated embodiment the upper impact absorbing structure 423 includes a first interface 439 (e.g., lateral surface) and the rear impact absorbing structure 411 includes a second interface 443 (e.g., lateral surface) that is in lateral compression against the first interface 439. The upper impact absorbing structure 423 further includes a first engagement portion 447 (FIG. 19) and the rear impact absorbing structure 411 includes a second engagement portion 451 (FIG. 18A) that engage respective receiving portions (e.g., vents) formed in the helmet body 314. The upper impact absorbing structure 423 also engages a first supporting structure 441 formed by the outer shell 334 and the rear impact absorbing structure 411 engages a second supporting structure 445 formed by the outer shell 334. In the illustrated embodiment, first and second supporting structures 441, 445 are each formed as inwardly extending lips on the outer shell 334. The first engagement portion 447 of the upper impact absorbing structure 423 may engage the vent edge 324 of the vent 319 formed in the upper wall 401 of the outer shell 334, and/or a front portion of the upper impact absorbing structure 423 may engage the first supporting structure 441. The second engagement portion 451 of the rear impact absorbing structure 411 may engage the vent edge 324 of the vent 319 formed in the rear wall 403 of the outer shell 334, and/or a lower portion of the rear impact absorbing structure 411 may engage the second supporting structure 445.

The upper impact absorbing structure 423 may be held in lateral compression (e.g., between the first interface 439 and the first engagement portion 447 and/or between the first interface 439 and the first supporting structure 441). In the illustrated embodiment, the first and second engagement portions 447, 451 are mechanically secured to the outer shell 334 (e.g., via a snap fit connection) at the vents 319 along the top and rear of the helmet 310. The combination of the connection of the upper and rear impact absorbing structures 423, 411 via the engagement portions 447, 451 and/or the supporting structures 441, 445 secures the upper and rear impact absorbing structures 423, 411 to the outer shell 334 and promotes the lateral compression between the interfaces 439, 443. In some embodiments, the first and second engagement portions 447, 451 of the rear and upper impact absorbing structures 411, 423 may be secured to the outer shell 334 by mechanically securing the first and second engagement portions 447, 451 to the outer shell 334 in other ways.

In some embodiments, the upper and rear impact absorbing structures 423, 411 may be coupled to the outer shell 334 and may be held in compression against one another at the interfaces 439, 443 solely via the contact of the upper and rear impact absorbing structures 423, 411 with the first and second supporting structures 441, 445 (e.g., lips of the outer shell), without the aid of the engagement portions 447, 451.

Figure 18B:
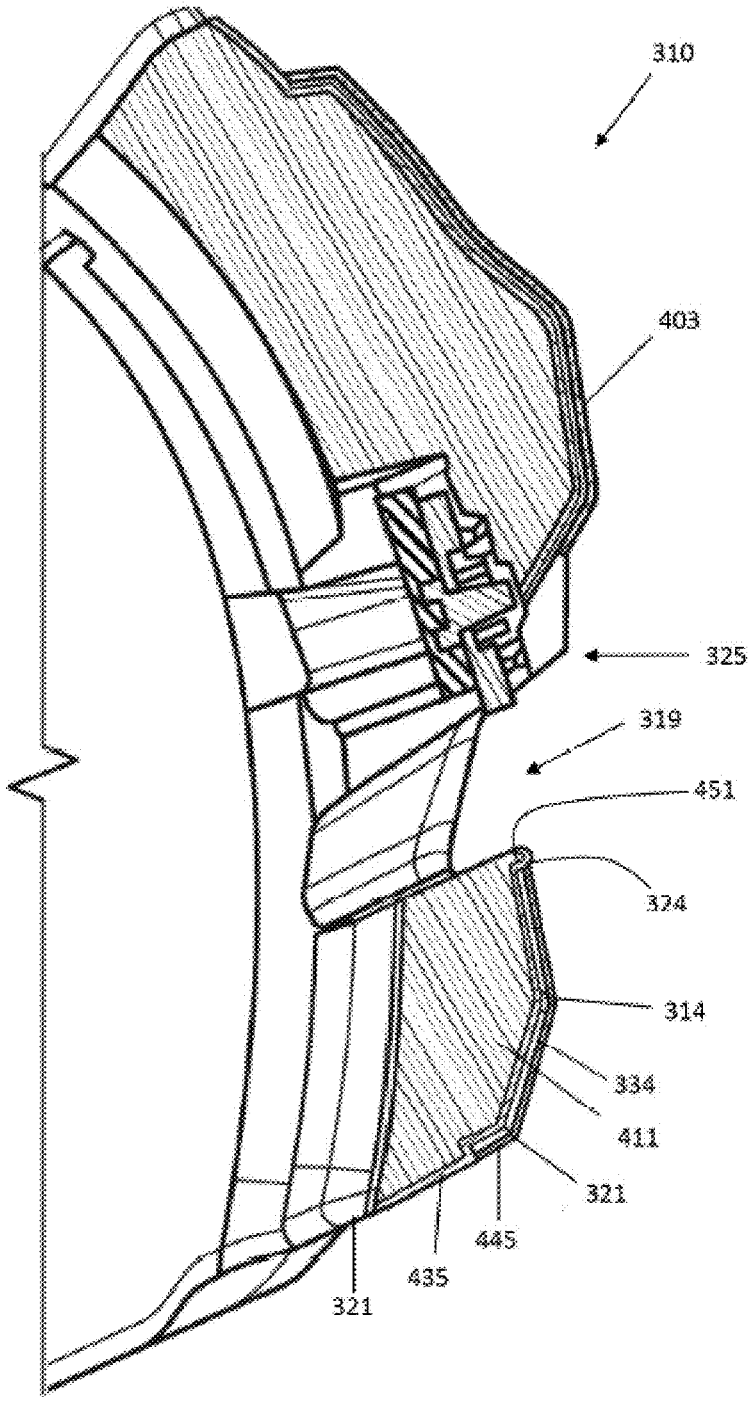
FIG. 18B is an enlarged, partial cross-sectional view of the bicycle helmet in FIG. 18A, illustrating an intermediate layer positioned between the impact absorbing structure and the outer shell of the helmet.

With reference to FIG. 18B, in the illustrated embodiment the inner shell 435, or a portion thereof, may be secured to an outer surface of the rear impact absorbing structure 411, and in some embodiments may be formed as part of the rear impact absorbing structure 411 (e.g., may be co-molded with the rear impact absorbing structure 411). Each of the impact absorbing structures may thus include its own inner shell 435 (e.g., outer layer). In the illustrated embodiment, for example, the rear impact absorbing structure 411 may include an energy-absorbing layer having a first density and the inner shell 435 may be formed of a material that has a higher density than the energy absorbing layer. For example, the energy-absorbing layer may be formed of expanded polystyrene and the inner shell 435 may be formed of polycarbonate. The inner shell 435 may form part of the engagement portion 451, which may engage the vent edge 324 to help secure the inner shell 435 and the impact absorbing structure 411 to the outer shell 334. The rear impact absorbing structure 411 may be coupled to the outer shell 334 via the inner shell 435.

In some embodiments, one or more of the impact absorbing structures (along for example with its associated inner shell 435) may not be directly adhered or directly mechanically fastened to the outer shell 334. In some embodiments, the impact absorbing structure (along for example with its inner shell 435) may not be indirectly adhered or indirectly mechanically fastened to the outer shell 334. The impact absorbing structures, such as the rear impact absorbing structure 411, may be removable from the outer shell 334. In addition, it should be appreciated that one or more of the remaining impact absorbing structures 415, 419, 423, 427 may have a similar construction as the rear impact absorbing structure 411 illustrated in FIG. 18B (e.g., may be formed of both an expanded polystyrene layer, as well as an outer polycarbonate layer).

Figure 22:
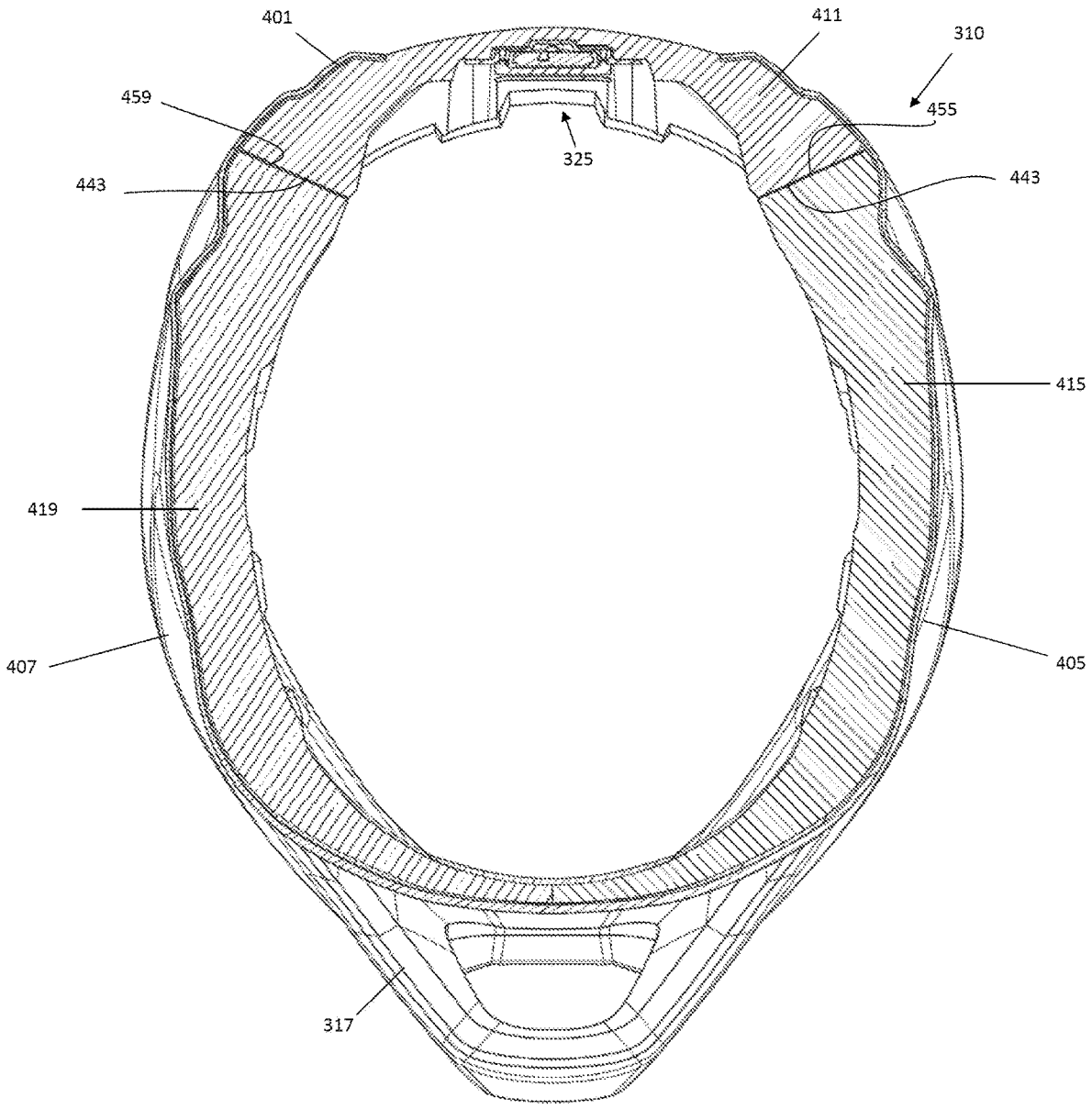
FIG. 22 is a top, cross-sectional view the bicycle helmet of FIG. 16 about the line 22-22 in FIG. 16, illustrating an interface of the rear impact absorbing structure with the left and the right impact absorbing structures.

With reference to FIGS. 20 and 22, in the illustrated embodiment the left impact absorbing structure 415 may include for example a third interface 455 and the right impact absorbing structure 419 may include a fourth interface 459. The third and fourth interfaces 455, 459 may each be in lateral compression against the first interface 439 of the upper impact absorbing structure 423 (FIG. 20) and the second interface 443 of the rear impact absorbing structure 411 (FIG. 22). The left impact absorbing structure 415 may further include a third engagement portion 463 and the right impact absorbing structure 419 may include a fourth engagement portion 467 that are sized to engage respective receiving portions (e.g., vents) formed in the helmet body 314. The left and right impact absorbing structure 415, 419 may engage third and fourth supporting structures 453, 457 formed by the outer shell 334. The third engagement portion 463 may engage the vent edge 324 of the vent 319 formed in the left wall 405 of the outer shell 334 and third supporting structure 453. The fourth engagement portion 467 may engage the vent edge 324 of the vent 319 formed in the right wall 407 of the outer shell 334 and the fourth supporting structure 457. The left impact absorbing structure 415 may be held in lateral compression between the first interface 439, the third engagement portion 463, and/or the third supporting structure 453. The right impact absorbing structure 419 may be held in lateral compression between the first interface 439, the fourth engagement portion 467, and/or the fourth supporting structure 457. In the illustrated embodiment, the third and fourth engagement portions 463, 467 may be mechanically secured to the outer shell 334 (e.g., via a snap fit connection).

Figure 21:
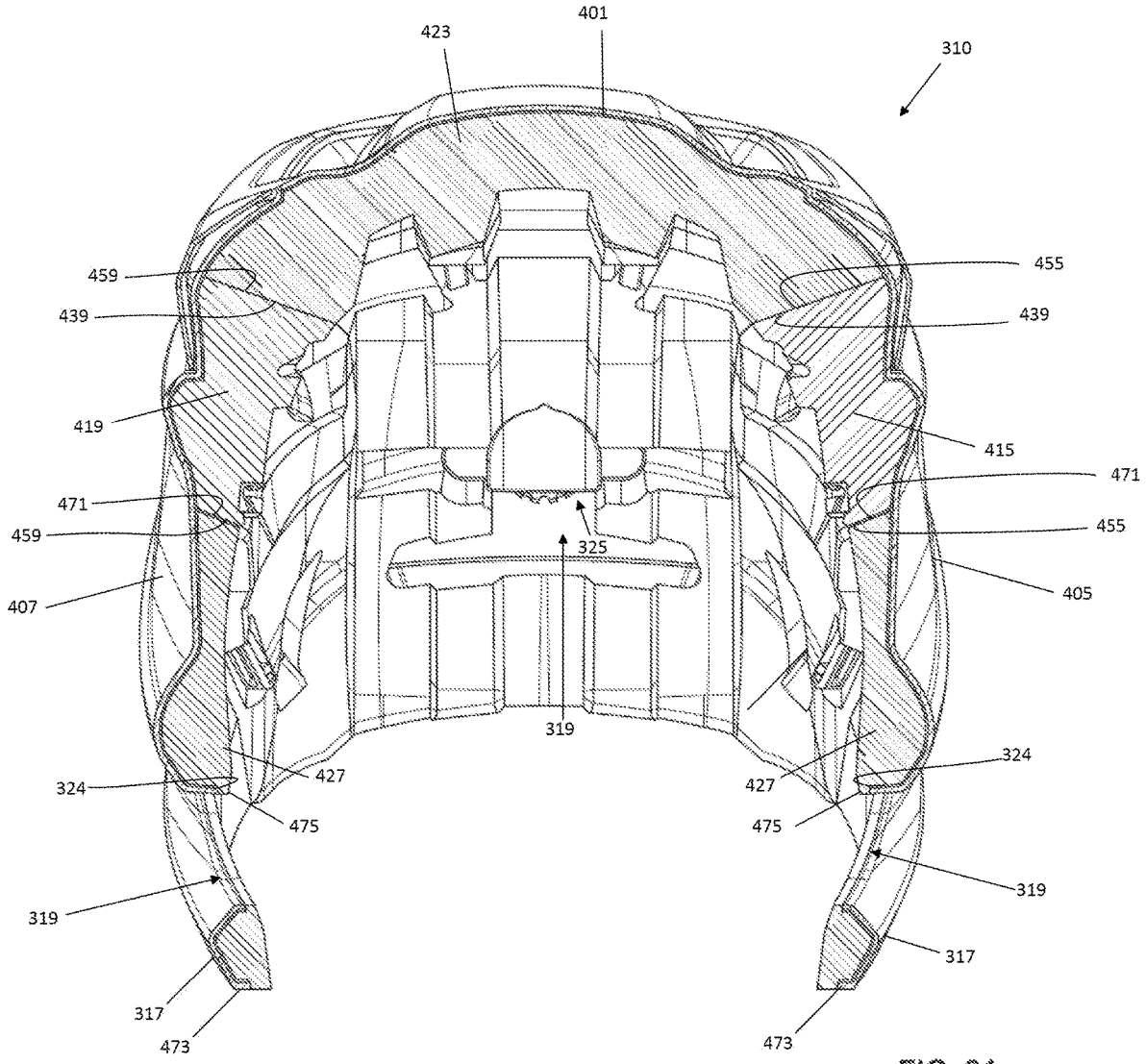
FIG. 21 is a front, cross-sectional view the bicycle helmet of FIG. 16 about the line 21-21 in FIG. 16, illustrating an interface of a chin strap impact absorbing structure with the outer shell of the helmet and the left and the right impact absorbing structures.

With reference to FIG. 21, the lower impact absorbing structure 427 may include a fifth interface 471 that is in lateral compression against each of the third and fourth interfaces 455, 459 of the left and right impact absorbing structures 415, 419. The lower impact absorbing structure 427 may further include a fifth engagement portion 475 that engages a receiving portion (e.g., vent) formed in the lower portion 317 of the helmet body 314. The fifth engagement portion 475 may engage the vent edge 324 of the vent 319 formed in the left wall 405 of the outer shell 334 and the vent edge 324 of the vent 319 formed in the right wall 407 of the outer shell 334. A lower portion of the lower impact absorbing structure 427 may engage a fifth supporting structure 473 (e.g., lower lip) formed in the left and right wall 405 of the outer shell 334. The lower impact absorbing structure 427 may be held in lateral compression between the third and fourth interfaces 455, 459, the fifth engagement portion 475 and/or the fifth supporting structure 473. In the illustrated embodiment, the fifth engagement portion 475 may be mechanically secured to the outer shell 334 (e.g., via a snap fit connection).

In some embodiments, during assembly of the helmet 310, two or more of the impact absorbing structures 411, 415, 419, 423, and/or 427 may be secured to the outer shell 334 of the helmet body 314 at least in part through compressing the impact absorbing structures 411, 415, 419, 423, and/or 427 and placing them into lateral compression with one another within the helmet 310. While the installation of the impact absorbing structures 411, 415, 419, 423, 427 are described in a sequential order below, it should be appreciated that the impact absorbing structures 411, 415, 419, 423, 427 may be installed within the helmet body 314 in any order.

With reference to FIG. 19, the upper impact absorbing structure 423 may be secured to the outer shell 334. For example, the front portion of the upper impact absorbing structure 423 may be moved towards and engage the first supporting structure 441 of the outer shell 334. A first deflecting portion of at least one of the upper impact absorbing structure 423 or the outer shell 334 may be deflected from a static position to a deflected position. In some embodiments, the vent edge 324 of the outer shell 334, a recess in the helmet body 314, the first supporting structure 441, the engagement portion 447, or the inner shell 435 (FIG. 18A) of the impact absorbing structure 423 itself may form the first deflecting portion. After deflecting the first deflecting portion, the upper impact absorbing structure 423 may be moved further towards the outer shell 334 and the first deflecting portion may be relaxed back from the deflected position toward the static position. In some embodiments, with the front portion of the upper impact absorbing structure 423 engaged with the first supporting structure 441, the first engagement portion 447 of the upper impact absorbing structure 423 may then contact the vent edge 324 formed in the upper wall 401 of the outer shell 334 to further secure the upper impact absorbing structure in place.

With reference to FIG. 18A, in some embodiments the rear impact absorbing structure 411 may then be inserted and laterally compressed against the upper impact absorbing structure 423 (e.g., at the interfaces 439, 443). For example, the lower portion of the rear impact absorbing structure 411 may be moved toward and engage the second supporting structure 445 of the outer shell 334. A second deflecting portion of at least one of the rear impact absorbing structure 411 or the outer shell 334 may be deflected from a second static position to a second deflected position. After deflecting the second deflecting portion, the rear impact absorbing structure 411 may be moved further toward the outer shell 334 and the second deflecting portion may be relaxed back from the second deflected position toward the second static position. In some embodiments, with the lower portion of the rear impact absorbing structure 411 engaged with the second supporting structure 445, the second engagement portion 451 of the rear impact absorbing structure 411 may then be moved to contact the vent edge 324 formed in the rear wall 403 of the outer shell 334 and the lower portion of the rear impact absorbing structure 411 may engage the second supporting structure 445 of the outer shell 334 to further secure the rear impact absorbing structure 411.

In some embodiments, the vents and vent edges 324 are not utilized to help further secure the rear impact absorbing structures 411 or the upper impact absorbing structure 423 to the outer shell, or to provide any compression. Instead, the compression between the upper impact absorbing structure 423 and the rear impact absorbing structures 411 at the interfaces 439, 443 may be entirely or substantially entirely due to the front end of the upper impact absorbing structure 423 pressing against the first supporting structure 441 (e.g., inner lip) and the bottom of the rear impact absorbing structure 411 pressing against the second supporting structure 445 (e.g. inner lip).

In some embodiments, the rear impact absorbing structure 411 may be laterally compressed against the upper impact absorbing structure 423 after the securing by lateral compression of the upper impact absorbing structure 423 with the outer shell 334 and the securing by lateral compression of the rear impact absorbing structure 411 with the outer shell 334. In other embodiments, the engaging of the rear impact absorbing structure 411 with the upper impact absorbing structure 423 may occur before contacting the rear impact absorbing structure 411 with the outer shell 334. In other words, the rear and upper impact absorbing structures 411, 423 may be laterally compressed together prior to mechanically securing the rear impact absorbing structures 411, 423 to the outer shell 334.

With reference to FIGS. 20 and 22, the left and right impact absorbing structures 415, 419 may be laterally compressed against each of the upper and rear impact absorbing structures 423, 411 (e.g., through the interfaces 455, 439, interfaces 459, 439 (FIG. 20), interfaces 443, 455 (FIG. 22), and interfaces 443, 459) after the securing by lateral compression of the upper and rear impact absorbing structures 423, 411 with the outer shell 334. The left and right impact absorbing structures 415, 419 may then be secured by lateral compression with the outer shell 334 by engaging each of the left and right impact absorbing structures 415, 419 with the outer shell 334. For example, a portion of each of the left and right impact absorbing structures 415, 419 may be moved towards and engage each of the third and fourth supporting structures 453, 457 of the outer shell 334. A third deflecting portion of at least one of the left impact absorbing structure 415 or the outer shell 334 may be deflected from a third static position to a third deflected position. After deflecting the third deflecting portion, the left impact absorbing structure 415 may be moved further toward the outer shell 334 and the third deflecting portion may be relaxed back from the third deflected position toward the third static position (e.g., to mechanically secure the left impact absorbing structure 415 in the outer shell 334). A fourth deflecting portion of at least one of the right impact absorbing structure 419 or the outer shell 334 may be deflected from a fourth static position to a fourth deflected position. After deflecting the forth deflecting portion, the right impact absorbing structure 419 may be moved further toward the outer shell 334 and the fourth deflecting portion may be relaxed back from the fourth deflected position toward the fourth static position (e.g., to mechanically secure the right impact absorbing structure 419 in the outer shell 334). In some embodiments, the third and fourth engagement portions 463, 467 of the left and right impact absorbing structures 415, 419 may contact the vent edge 324 formed in the left wall 405 and right wall 407 of the outer shell 334.

With reference to FIG. 21, the lower impact absorbing structure 427 may be laterally compressed against each of the left and right impact absorbing structures 415, 419 (e.g., through the interfaces 455, 471, and interfaces 459, 471) after the securing by lateral compression of the upper, rear, left, and right impact absorbing structures 423, 411, 415, 419 with the outer shell 334. The lower impact absorbing structure 427 may be secured by lateral compression with the outer shell 334 by engaging the lower impact absorbing structure 427 with the outer shell 334. For example, the lower portion of the lower impact absorbing structure 427 may be moved towards and engage the fifth supporting structure 473 of the outer shell 334. A fifth deflecting portion of at least one of the lower impact absorbing structure 427 or the outer shell 334 may be deflected from a fifth static position to a fifth deflected position. After deflecting the fifth deflecting portion, the lower impact absorbing structure 427 may be moved further toward the outer shell 334 and the fifth deflecting portion may be relaxed back from the fifth deflected position toward the fifth static position to mechanically secure the lower impact absorbing structure 427 in the outer shell 334. For example, the fifth engagement portion 475 of the lower impact absorbing structure 427 may contact the vent edges 324 formed in the left wall 405 and right wall 407 of the lower portion 317 of the outer shell 334.

Similar to the upper and rear impact absorbing structures 423, 411, the left, right, and lower impact absorbing structures 415, 419, 427 may also rely partially or entirely on inner lips or other supporting structures (e.g., such as supporting structure 473) on the outer shell 334 to provide compression between two or more of the impact absorbing structures. The vents and/or recesses along the outer shell 334 may then provide other locations for helping to secure the impact absorbing structures, and/or for providing additional compression to help hold the impact absorbing structures in place against one another.

In some embodiments, all of the impact absorbing structures 411, 415, 419, 423, 427 may be laterally compressed together to form a single, uniform impact absorbing layer 330. As noted above, each of the impact absorbing structures 411, 415, 419, 423, 427 may include or be coupled to a separate inner shell 435. Other embodiments include different numbers and arrangements of impact absorbing structures than that illustrated.

Clause 1: A helmet comprises an outer shell having an interior and an exterior, and an impact absorbing layer positioned on the interior of the outer shell, the impact absorbing layer comprising a first impact absorbing structure having a first interface and a second impact absorbing structure having a second interface in lateral compression against the first interface.

Clause 2: The helmet of Clause 1, wherein the first impact absorbing structure includes a first engagement portion that engages the outer shell such that the first impact absorbing structure is held in lateral compression between the first interface and the first engagement portion.

Clause 3: The helmet of Clause 2, wherein the outer shell comprises a vent opening defined by a vent edge, and wherein the first engagement portion engages the vent edge.

Clause 4: The helmet of Clause 2, wherein the first impact absorbing structure comprises an energy-absorbing layer and an inner shell secured to an outer surface of the energy-absorbing layer, wherein the inner shell includes the first engagement portion.

Clause 5: The helmet of Clause 4, wherein the inner shell comprises a material having a higher density than the energy-absorbing layer.

Clause 6: The helmet of Clause 5, wherein the inner shell comprises polycarbonate and the energy-absorbing layer comprises expanded polystyrene.

Clause 7: The helmet of Clause 1, wherein the outer shell comprises an upper wall, a rear wall, a left wall and a right wall, wherein the first impact absorbing structure comprises an upper impact absorbing structure adjacent the upper wall and the second impact absorbing structure comprises a rear impact absorbing structure adjacent the rear wall.

Clause 8: A helmet comprises an outer shell having a first receiving portion, and an impact absorbing layer positioned on an interior side of the outer shell, the impact absorbing layer comprising an impact absorbing structure having a first engagement portion and a second engagement portion spaced from the first engagement portion, wherein the impact absorbing structure is mechanically secured to the outer shell by the first engagement portion engaging the first receiving portion and the second engagement portion engaging a second receiving portion spaced from the first receiving portion.

Clause 9: The helmet of Clause 8, wherein the impact absorbing structure is held in lateral compression between the first engagement portion and the second engagement portion.

Clause 10: The helmet of Clause 8, wherein the outer shell comprises a vent, and wherein the first receiving portion comprises a vent edge defining at least a portion of the vent.

Clause 11: The helmet of Clause 10, wherein the second receiving portion comprises a recess in the outer shell.

Clause 12: The helmet of Clause 8, wherein the first receiving portion comprises a first recess in the outer shell, and wherein the second receiving portion comprises a second recess in the outer shell.

Clause 13: The helmet of Clause 8, wherein the impact absorbing layer comprises a second impact absorbing structure, wherein the first receiving portion comprises a vent or a recess in the outer shell, and wherein the second receiving portion comprises a lateral surface of the second impact absorbing structure.

Clause 14: The helmet of Clause 8, wherein the impact absorbing structure comprises an energy-absorbing layer and an inner shell secured to an outer surface of the energy-absorbing layer, wherein the inner shell includes the first engagement portion.

Clause 15: The helmet of Clause 14, wherein the inner shell comprises a material having a higher density than the energy-absorbing layer.

Clause 16: The helmet of Clause 14, wherein the inner shell comprises polycarbonate and the energy-absorbing layer comprises expanded polystyrene.

Clause 17: The helmet of Clause 8, wherein the impact absorbing structure is not directly adhered to the outer shell, wherein the impact absorbing structure is not indirectly adhered to the outer shell, wherein the impact absorbing structure is not directly mechanically fastened to the outer shell, and wherein the impact absorbing structure is not indirectly mechanically fastened to the outer shell.

Clause 18: A method of assembling a helmet from an outer shell and multiple impact absorbing structures comprises securing by lateral compression a first impact absorbing structure with the outer shell. The securing by lateral compression the first impact absorbing structure with the outer shell comprises contacting the first impact absorbing structure with the outer shell, deflecting a first deflecting portion of at least one of the first impact absorbing structure or the outer shell from a static position to a deflected position, moving the first impact absorbing structure further toward the outer shell, and relaxing the first deflecting portion back from the deflected position toward the static position to mechanically secure the first impact absorbing structure in the outer shell.

Clause 19: The method of Clause 18, wherein the outer shell comprises a vent defined by a vent edge, and wherein the contacting the first impact absorbing structure with the outer shell comprises contacting the first impact absorbing structure with the vent edge.

Clause 20: The method of Clause 18, wherein the first impact absorbing structure comprises an energy-absorbing layer and an inner shell secured to an outer surface of the energy-absorbing layer, and wherein contacting the first impact absorbing structure with the outer shell comprises contacting the inner shell with the outer shell.

Clause 21: The method of Clause 18, further comprising securing by lateral compression a second impact absorbing structure with the outer shell. The securing by lateral compression the second impact absorbing structure with the outer shell comprises engaging the second impact absorbing structure with the first impact absorbing structure, contacting the second impact absorbing structure with the outer shell, deflecting a second deflecting portion of at least one of the second impact absorbing structure or the outer shell from a second static position to a second deflected position, moving the second impact absorbing structure further toward the outer shell, and relaxing the second deflecting portion back from the second deflected position toward the second static position to mechanically secure the second impact absorbing structure in the outer shell.

Clause 22: The method of Clause 21, wherein the second impact absorbing structure is laterally compressed against the first impact absorbing structure after the securing by lateral compression the first impact absorbing structure with the outer shell and the securing by lateral compression the second impact absorbing structure with the outer shell.

Clause 23: The method of Clause 21, wherein the engaging the second impact absorbing structure with the first impact absorbing structure occurs before the contracting the second impact absorbing structure with the outer shell.

Clause 24: The method of Clause 21, wherein the outer shell comprises an upper wall, a rear wall, a left wall, and a right wall, and wherein the first impact absorbing structure comprises an upper impact absorbing structure positioned adjacent the upper wall and the second impact absorbing structure comprises a rear impact absorbing structure positioned adjacent the rear wall.

Clause 25: The method of Clause 24, further comprising securing by lateral compression a left impact absorbing structure with the outer shell. The securing by lateral compression the left impact absorbing structure with the outer shell comprises engaging the left impact absorbing structure with the upper impact absorbing structure, contacting the left impact absorbing structure with the outer shell, deflecting a left deflecting portion of at least one of the left impact absorbing structure or the outer shell from a third static position to a third deflected position, moving the left impact absorbing structure further toward the outer shell, and relaxing the left deflecting portion back from the third deflected position toward the third static position to mechanically secure the left impact absorbing structure in the outer shell.

Clause 26: The method of Clause 25, further comprising securing by lateral compression a right impact absorbing structure with the outer shell. The securing by lateral compression the right impact absorbing structure with the outer shell comprises engaging the right impact absorbing structure with the upper impact absorbing structure, contacting the right impact absorbing structure with the outer shell, deflecting a right deflecting portion of at least one of the right impact absorbing structure or the outer shell from a fourth static position to a fourth deflected position, moving the right impact absorbing structure further toward the outer shell, and relaxing the right deflecting portion back from the fourth deflected position toward the fourth static position to mechanically secure the right impact absorbing structure in the outer shell.

Clause 27: A bicycle helmet comprises a helmet body adapted to cover at least a portion of a rider's head, the helmet body including a wall portion and a vent extending through the wall portion from an exterior of the helmet body to an interior of the helmet body, and an adjusting assembly for adjustably securing the helmet to a user's head, the adjusting assembly including an adjusting input movable to adjust a size of the helmet, the adjusting input being positioned at least partially in the vent.

Clause 28: The bicycle helmet of Clause 27, wherein the helmet body comprises an outer shell, and an impact absorbing layer positioned on an interior side of the outer shell, wherein the vent is defined at least partially by a vent surface of the impact absorbing layer.

Clause 29: The bicycle helmet of Clause 28, where the vent surface includes a recess and wherein the adjusting assembly is positioned at least partially in the recess.

Clause 30: The bicycle helmet of Clause 29, wherein a recessed portion of the adjusting input is positioned in the recess and an exposed portion of the adjusting input is positioned in the vent.

Clause 31: The bicycle helmet of Clause 30, wherein the adjusting input comprises a rotating dial.

Clause 32: The bicycle helmet of Clause 31, wherein the rotating dial has a diameter, and wherein the exposed portion is 1%-15% of the diameter.

Clause 33: The bicycle helmet of Clause 31, wherein the rotating dial has a diameter, and wherein the recessed portion is 5%-30% of the diameter.

Clause 34: The bicycle helmet of Clause 31, wherein the adjusting assembly further comprises an adjusting housing rotationally supporting the adjusting input and fully positioned in the recess.

Clause 35: The bicycle helmet of Clause 27, wherein the adjusting assembly further includes a strap member positioned to wrap at least partially around a user's head, the strap member being coupled to and movable by the adjusting input.

Clause 36: The bicycle helmet of Clause 27, wherein the vent is located on a rear portion of the helmet body.

Clause 37: The bicycle helmet of Clause 27, wherein the vent is located on a lower portion of the helmet body.

Clause 38: The bicycle helmet of Clause 27, wherein the adjusting assembly further comprises an adjusting housing rotationally supporting the adjusting input.

Clause 39: The bicycle helmet of Clause 38, wherein a first portion of the adjusting input is positioned in the adjusting housing and an exposed portion of the adjusting input is positioned in the vent.

Clause 40: The bicycle helmet of Clause 39, wherein the adjusting input comprises a rotating dial.

Clause 41: The bicycle helmet of Clause 40, wherein the rotating dial has a diameter, and wherein the exposed portion is 1%-15% of the diameter.

Clause 42: The bicycle helmet of Clause 40, wherein the rotating dial has a diameter, and wherein the exposed portion is 10%-40% of the diameter.

Clause 43: The bicycle helmet of Clause 40, wherein the vent is located on a rear portion of the helmet body.

Clause 44: The bicycle helmet of Clause 43, wherein the vent is defined by a lower vent surface and an upper vent surface, wherein the upper vent surface tapers toward the lower vent surface.

Clause 45: The bicycle helmet of Clause 27, wherein the helmet includes an impact absorbing layer defining a recess, wherein at least a portion of the adjusting assembly is disposed within the recess.

Clause 46: The bicycle helmet of Clause 45, wherein the adjusting input comprises a rotating dial.

Various features of the disclosure are set forth in the following claims.

The invention claimed is:

1. A helmet comprising:

an outer shell having an interior shell surface and an opposite exterior shell surface; and an impact absorbing layer positioned on the interior shell surface of the outer shell, wherein the impact absorbing layer includes a first impact absorbing structure having a first interior surface facing an interior cavity of the helmet, an opposite first exterior surface in contact with the interior shell surface, and a first interface that extends from the first interior surface to the first exterior surface, wherein the impact absorbing layer further includes a second impact absorbing structure having a second interior surface facing the interior cavity of the helmet, an opposite second exterior surface in contact with the interior shell surface, and a second interface that extends from the second interior surface to the second exterior surface, wherein at least part of the second interface is in lateral compression against at least part of the first interface;

wherein the first impact absorbing structure includes a first engagement portion that engages the outer shell such that the first impact absorbing structure is held in lateral compression between the at least part of the first interface and the first engagement portion.

2. A helmet as claimed in claim 1, wherein the outer shell comprises a vent opening defined by a vent edge, and wherein the first engagement portion engages the vent edge.

3. A helmet as claimed in claim 1, wherein the second impact absorbing structure comprises an energy-absorbing layer and an inner shell secured to an outer surface of the energy-absorbing layer, wherein the inner shell includes a second engagement portion.

4. A helmet as claimed in claim 3, wherein the inner shell comprises a material having a higher density than the energy-absorbing layer.

5. A helmet as claimed in claim 4, wherein the inner shell comprises polycarbonate and the energy-absorbing layer comprises expanded polystyrene.

6. A helmet as claimed in claim 1, wherein the outer shell comprises an upper wall, a rear wall, a left wall and a right wall, wherein the first impact absorbing structure comprises an upper impact absorbing structure adjacent the upper wall and the second impact absorbing structure comprises a rear impact absorbing structure adjacent the rear wall.

7. A helmet comprising:

an outer shell having a first receiving portion; and an impact absorbing layer positioned on an interior side of the outer shell, the impact absorbing layer comprising a first impact absorbing structure having a first engagement portion and a second impact-absorbing structure having a second engagement portion spaced from the first engagement portion, wherein the first impact absorbing structure is mechanically secured to the outer shell by the first engagement portion engaging the first receiving portion and the second impact-absorbing structure is mechanically secured to the outer shell by the second engagement portion engaging a second receiving portion spaced from the first receiving portion;

wherein the first receiving portion comprises a vent or a recess in the outer shell, wherein the second impact-absorbing structure includes an inner shell, and wherein the inner shell includes the second engagement portion;

wherein the first impact absorbing structure is held in lateral compression against the second impact absorbing structure.

8. A helmet as claimed in claim 7, wherein the first receiving portion comprises a vent edge defining at least a portion of the vent or recess.

9. A helmet as claimed in claim 8, wherein the second receiving portion comprises a recess in the outer shell.

10. A helmet as claimed in claim 7, wherein the first receiving portion is along a top of the helmet, and wherein the second receiving portion is along a rear of the helmet.

11. A helmet as claimed in claim 7, wherein the second impact absorbing structure comprises an energy-absorbing layer and wherein the inner shell is secured to an outer surface of the energy-absorbing layer.

12. A helmet as claimed in claim 11, wherein the inner shell comprises a material having a higher density than the energy-absorbing layer.

13. A helmet as claimed in claim 12, wherein the inner shell comprises polycarbonate and the energy-absorbing layer comprises expanded polystyrene.

14. A helmet as claimed in claim 7, wherein the impact absorbing layer defines a rear vent along a rear of the helmet that is separate from the first receiving portion, wherein the helmet further comprises an adjusting assembly for adjustably securing the helmet to a user's head, the adjusting assembly including an adjusting input movable to adjust a size of the helmet, the adjusting input being positioned at least partially in the rear vent.

15. A helmet comprising:

an outer shell having an interior shell surface and an opposite exterior shell surface; and an impact absorbing layer positioned on the interior shell surface of the outer shell, wherein the impact absorbing layer includes a first impact absorbing structure having a first interior surface facing an interior cavity of the helmet, an opposite first exterior surface in contact with the interior shell surface, and a first interface that extends from the first interior surface to the first exterior surface, wherein the impact absorbing layer further includes a second impact absorbing structure having a second interior surface facing the interior cavity of the helmet, an opposite second exterior surface in contact with the interior shell surface, and a second interface that extends from the second interior surface to the second exterior surface, wherein at least part of the second interface is in lateral compression against at least part of the first interface;

wherein the outer shell comprises an upper wall, a rear wall, a left wall and a right wall, wherein the first impact absorbing structure comprises an upper impact absorbing structure adjacent the upper wall and the second impact absorbing structure comprises a rear impact absorbing structure adjacent the rear wall.

16. A helmet as claimed in claim 15, wherein the first impact absorbing structure includes a first engagement portion that engages the outer shell such that the first impact absorbing structure is held in lateral compression between the at least part of the first interface and the first engagement portion, wherein the outer shell comprises a vent opening defined by a vent edge, and wherein the first engagement portion engages the vent edge.

17. A helmet as claimed in claim 16, wherein the second impact absorbing structure comprises an energy-absorbing layer and an inner shell secured to an outer surface of the energy-absorbing layer, wherein the inner shell includes a second engagement portion.

18. A helmet as claimed in claim 17, wherein the inner shell comprises a material having a higher density than the energy-absorbing layer.

19. A helmet as claimed in claim 18, wherein the inner shell comprises polycarbonate and the energy-absorbing layer comprises expanded polystyrene.

* * * * *